US006922847B2

(12) United States Patent
Bachner, Jr.

(10) Patent No.: US 6,922,847 B2
(45) Date of Patent: Aug. 2, 2005

(54) MULTIPURPOSE THIN AND LIGHTWEIGHT STAB AND BALLISTIC RESISTANT BODY ARMOR AND METHOD

(75) Inventor: Thomas E. Bachner, Jr., Eastport, MI (US)

(73) Assignee: Second Chance Body Armor, Inc., Central Lake, MI (US)

( * ) Notice: Subject to any disclaimer, the term of this patent is extended or adjusted under 35 U.S.C. 154(b) by 288 days.

(21) Appl. No.: 10/205,994

(22) Filed: Jul. 26, 2002

(65) Prior Publication Data

US 2004/0016036 A1 Jan. 29, 2004

(51) Int. Cl.[7] ..... F41H 1/02
(52) U.S. Cl. ..... 2/2.5; 2/455
(58) Field of Search ..... 2/2.5, 455, 456; 428/911; 442/232, 234; 89/36.02, 36.05

(56) References Cited

U.S. PATENT DOCUMENTS

| | | | | |
|---|---|---|---|---|
| 3,841,954 | A | | 10/1974 | Lewler |
| 3,974,313 | A | | 8/1976 | James |
| 4,608,717 | A | | 9/1986 | Dunbavand |
| 4,989,266 | A | | 2/1991 | Borgese et al. |
| 5,120,599 | A | | 6/1992 | Lewis |
| 5,179,244 | A | | 1/1993 | Zufle |
| 5,180,880 | A | | 1/1993 | Zufle |
| 5,185,195 | A | | 2/1993 | Harpell et al. |
| 5,196,252 | A | | 3/1993 | Harpell |
| 5,198,280 | A | | 3/1993 | Harpell et al. |
| 5,233,821 | A | | 8/1993 | Weber, Jr. et al. |
| 5,343,796 | A | | 9/1994 | Cordova et al. |
| 5,440,965 | A | | 8/1995 | Cordova et al. |
| 5,443,882 | A | | 8/1995 | Park |
| 5,443,883 | A | | 8/1995 | Park |
| 5,461,839 | A | | 10/1995 | Beck |
| 5,466,503 | A | | 11/1995 | Dischler |
| 5,479,659 | A | | 1/1996 | Bachner, Jr. |
| 5,526,627 | A | | 6/1996 | Beck |
| 5,545,455 | A | | 8/1996 | Prevorsek et al. |
| 5,569,509 | A | | 10/1996 | Dischler |
| 5,589,254 | A | | 12/1996 | Dischler |
| 5,595,809 | A | | 1/1997 | Dischler |
| 5,619,748 | A | | 4/1997 | Nelson et al. |
| 5,635,288 | A | | 6/1997 | Park |
| 5,677,029 | A | | 10/1997 | Prevorsek et al. |
| 5,724,670 | A | | 3/1998 | Price |
| 5,773,370 | A | | 6/1998 | Dunbar et al. |
| 5,776,838 | A | | 7/1998 | Dellinger |
| 5,788,907 | A | | 8/1998 | Brown, Jr. et al. |
| 5,789,327 | A | | 8/1998 | Rousseau |
| 5,839,247 | A | | 11/1998 | Beck |
| 5,918,309 | A | | 7/1999 | Bachner, Jr. |
| 5,926,842 | A | | 7/1999 | Price et al. |
| 5,935,678 | A | | 8/1999 | Park |
| 5,958,804 | A | | 9/1999 | Brown, Jr. et al. |
| 5,965,223 | A | | 10/1999 | Andrews et al. |
| 6,026,509 | A | * | 2/2000 | Bachner, Jr. ..... 2/2.5 |
| 6,151,710 | A | | 11/2000 | Bachner, Jr. |
| 6,219,842 | B1 | * | 4/2001 | Bachner, Jr. ..... 2/2.5 |
| 6,240,557 | B1 | | 6/2001 | Bachner, Jr. |
| 6,449,769 | B1 | * | 9/2002 | Bachner, Jr. ..... 2/2.5 |
| 6,684,404 | B2 | * | 2/2004 | Bachner et al. ..... 2/2.5 |
| 6,705,197 | B1 | * | 3/2004 | Neal ..... 89/36.05 |

FOREIGN PATENT DOCUMENTS

| | | |
|---|---|---|
| WO | WO 00/42246 | 7/2000 |
| WO | WO 00/55565 | 9/2000 |

OTHER PUBLICATIONS

Toyobo Co., Ltd., PBO Fiber Zylon™ New High Peformance Fiber Pioneered by Toyobo, Undated, 6 Pages, by Toyobo Co., Ltd., Osaka, Japan.

* cited by examiner

*Primary Examiner*—Gary L. Welch
(74) *Attorney, Agent, or Firm*—Wildman, Harrold, Allen & Dixon, LLP; Thomas J. Ring

(57) ABSTRACT

A multipurpose ballistic and stab resistant garment is provided having a ballistic and stab resistant pad. The pad has puncture resistant sheets of woven aramid fibers that are formed from a weave of at least sixty warp fibers per inch and 60 weft fibers per inch. The pad has ballistic resistant sheets of woven lyotropic liquid crystal polymer fiber.

98 Claims, 7 Drawing Sheets

FIG. 4
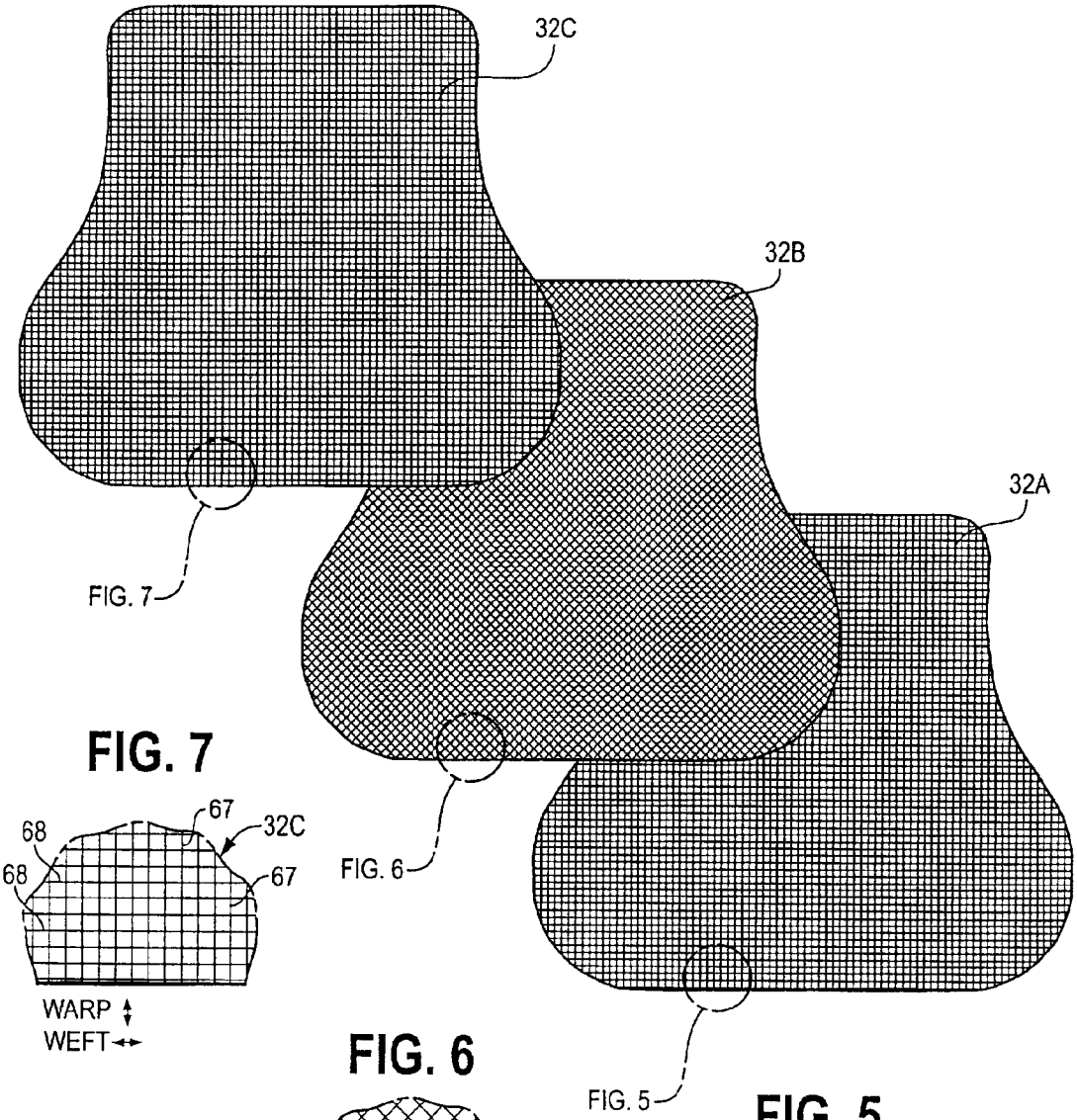
FIG. 7
FIG. 6
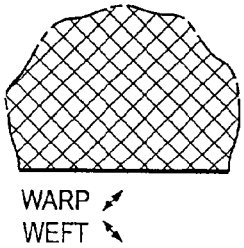
FIG. 5
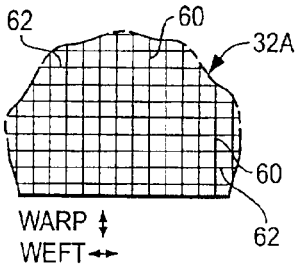

MULTIPURPOSE THIN AND LIGHTWEIGHT STAB AND BALLISTIC RESISTANT BODY ARMOR AND METHOD

FIELD OF THE INVENTION

The present invention relates to the field of protective body armor and more particularly to stab and ballistic resistant body armor pads.

BACKGROUND OF THE INVENTION

In the evolution of protective garments, there has been an ever pressing desire to develop stronger, lighter, thinner, cooler, more breathable and thereby more wearable garments. Such garments include ballistic resistant garments which are made to resist potentially lethal forces such as those from gun shots. Typically, these ballistic resistant garments are designed to protect the wearer from ballistic forces by preventing penetration through a protective pad of the garment from a projectile bullet.

Puncture or stab resistant protective garments have also been developed which have layers of woven sheets of a puncture resistant pad which is constructed to protect puncture penetration from a sharp object through the pad. Examples of such puncture or stab resistant garments may be found in U.S. Pat. Nos. 5,960,470 and 6,154,880 of T. E. Bachner, Jr. and assigned to Second Chance Body Armor, Inc. Multipurpose body armor garments have also been developed by Second Chance Body Armor, Inc. in which a protective pad has both a ballistic resistant panel and a puncture resistant panel for protection against ballistic threats and stab/slash threats from sharp objects or weapons. Examples of such combined puncture resistant and ballistic resistant protective garments can be found in U.S. Pat. Nos. 6,131,193 and 6,219,842 of T. E. Bachner, Jr. and assigned to Second Chance Body Armor, Inc.

Recently, voluntary governmental stab resistant test criteria standards have been established to certify certain stab resistant garments. The tests determine the ability of the stab resistant body armor article to provide protection against injury from penetration from knives, edged weapons, and sharp pointed objects while ensuring that the movement of the wearer is not unduly restricted. In particular, the National Institute of Justice (NIJ) 0115.00 Standard Certification tests are tests for determining the stab resistance of certain personal body armor products. The NIJ Standard—0115.00 tests are grouped into different Protection Levels (Spike Level 1, Spike Level 2, Spike Level 3). With each Protection Level, the test protocol requires the knife blade or spike to impact the armor test sample at two distinct energy levels; called "E1" and "E2". For the "E1" energy level, a maximum blade or spike penetration of 7 mm (0.28 in) is allowable. The test protocol then requires an overtest condition where the knife blade or spike kinetic energy is increased by 50%. At this higher energy condition, called "E2," a maximum blade or spike penetration of 20 mm (0.79 in) is allowable.

Table 1 describes the three protection levels for stab resistant body armor.

TABLE 1

Stab resistant protection level strike energies

| Protection | "E1" Strike Energy | | "E2" Overtest Strike Energy | |
|---|---|---|---|---|
| Level | J | ft · lbf | J | ft · lbf |
| Spike Level 1 | 24 ± 0.50 | 17.7 ± 0.36 | 36 ± 0.60 | 26.6 ± 0.44 |
| Spike Level 2 | 33 ± 0.60 | 24.3 ± 0.44 | 50 ± 0.70 | 36.9 ± 0.51 |
| Spike Level 3 | 43 ± 0.60 | 31.7 ± 0.44 | 65 ± 0.80 | 47.9 ± 0.59 |

Further details on NIJ Standard 0115.00 may be found at National Institute of Justice Law Enforcement and Corrections Standards and Testing Program, "Stab Resistance of Personal Body Armor NIJ Standard—0115.00", NCJ 183652, September 2000.

Various voluntary governmental ballistic standards have also been established to certify certain ballistic resistant garments. The tests determine the ability of the garment to resist penetration and also measure backface signature resulting from various ballistic rounds shot from various types of weapons. In particular, the National Institute of Justice (NIJ) Standard 0101.04 certification tests are ballistics tests for certifying certain body armor products. The NIJ Standard 0101.04 tests are grouped into different Threat Levels, with each Threat Level corresponding to ballistic projectile penetration stopping capabilities of various ballistic rounds fired from designated weapons. The different Threat Levels have defined criteria for defeating certain ballistic rounds and number of rounds fired as well as defined backface signature requirements. For generally concealable type ballistic resistant body armor NIJ Standard certification tests are often performed for NIJ Threat Levels IIA, II and IIIA. NIJ Threat Level IIIA is a higher standard level than NIJ Threat Level II and which in turn is a higher standard level than NIJ Threat Level IIA.

Accordingly, there is a need to provide thin and lightweight multipurpose body armor which provides both stab and ballistic resistant capabilities which meet stab and ballistic certification tests.

BRIEF DESCRIPTION OF THE DRAWINGS

FIG. 4 is an exploded view illustrating example ballistic resistant sheets (without stitching being shown) of ballistic resistant panel.

FIG. 5 is an enlarged view of a weave of a ballistic resistant sheet seen at the circle identified as FIG. 5 in FIG. 4.

FIG. 6 is an enlarged view of weave of a ballistic resistant sheet seen at the circle identified as FIG. 6 in FIG. 4.

FIG. 7 is an enlarged view of a weave of a ballistic resistant sheet seen at the circle identified as FIG. 7 in FIG. 4.

DETAILED DESCRIPTION

Figure 1:
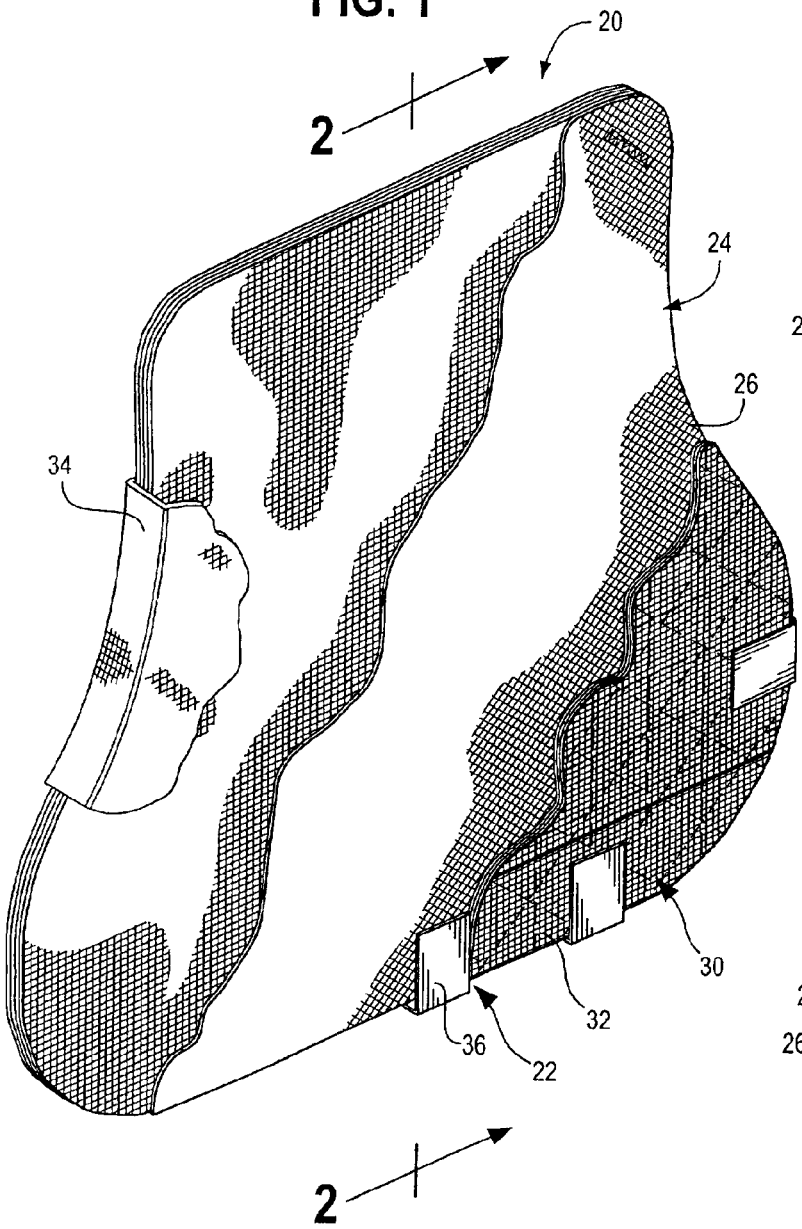
FIG. 1 is a perspective view of a multipurpose stab and ballistic resistant garment.

Referring to FIG. 1, multipurpose ballistic and stab resistant garment 20 is shown having a multipurpose stab and ballistic resistant pad 22. The pad 22 has puncture resistant panel 24 with multiple puncture resistant sheets 26 of woven aramid fibers. The puncture resistant sheets 26 are formed from a weave of at least sixty (60) aramid warp fibers per inch and at least sixty (60) aramid weft fibers per inch. The multipurpose stab and ballistic resistant pad 22 also has a ballistic resistant panel 30 of multiple ballistic resistant sheets 32 of woven lyotropic liquid crystal polymer fiber. The ballistic resistant sheets 32 may selectively have a weave with a warp of less than sixty (60) lyotropic liquid crystal polymer fibers per inch and a weft of less than sixty (60) lyotropic liquid crystal polymer fibers per inch. In one example, the high strength lyotropic liquid crystal polymer warp and weft fibers of the individual woven ballistic resistant sheets 32 are woven in a plain weave of 25×24 lyotropic liquid crystal polymer fibers per inch; however various balanced or imbalanced weaves may be employed.

As seen in FIG. 1, a pad cover 34 constructed of waterproof and moisture vapor permeable material is used to cover and enclose the puncture resistant sheets 26 and the ballistic resistant sheets 32 of the stab and ballistic resistant pad 22. It will be appreciated that pad cover 34 encloses the entire pad 22. To protect the pad 22 from outer elements, and body oils and salts, pad cover 34 is constructed at least in part of a waterproof oleophobic and moisture vapor permeable material, such as GORE-TEX® manufactured by W. L. Gore & Associates, Inc., for covering and enclosing the puncture resistant sheets 26 and ballistic sheets 32 of the pad 22. Pad cover 34 may alternatively utilize Supplex®, a highly breathable material formed from nylon and treated with dynamic water repellant which is made by E. I. Dupont de Nemours & Company. Other covering materials may selectively be used such as rip stop nylon. The set of puncture resistant sheets 26 in panel 24 and the set of ballistic resistant sheets 32 in panel 30 are non-invasively held to each other. In one example, tape 36 is used to hold the puncture resistant sheets 26 and ballistic resistant sheets 32 to each other.

In the example seen in FIG. 1, the puncture resistant sheets 26 are positioned at a strike side of the garment 20 relative to the ballistic resistant sheets 32. The puncture resistant sheets 26 may selectively have woven aramid fibers having: filaments which provide from 50,000,000 to 90,000,000 filament crossovers per square inch; a break elongation of greater than 3.0 percent; and a tenacity of greater than 23.8 grams per denier. In one example, the aramid fibers woven in the sheets 26 of puncture resistant panel 24 are at least 200 denier, have a break elongation of at least 3.45 percent, and a tenacity of at least 27.0 grams per denier. The aramid fibers may selectively be constructed of Kevlar® 159, manufactured by E. I. Dupont de Nemours & Company of Wilmington, Delaware, and may be selectively woven into a 70 fiber per inch×70 fiber per inch weave in the puncture resistant sheets. For further details on the fibers of the puncture resistant sheets, reference can be made to U.S. Pat. No. 5,960,470 of Bachner, which is assigned to the assignee of the present invention and which is incorporated herein by reference.

The lyotropic liquid crystal polymer fiber woven in the weave of the ballistic resistant sheets 32 may selectively be formed from poly(p-phenylene-2,6-benzobisoxazole). The lyotropic liquid crystal polymer fiber generally may have one or more of the following characteristics: a) a filament denier of 1.5 dpf; b) a density ranging from 1.54 to 1.56 g/cm$^3$; c) a tensile strength of 42 grams/denier; d) a tensile modulous ranging from 1300 to 2000 grams/denier; e) a decomposition temperature in air of 650 degrees centigrade; and f) a break elongation ranging from 2.5 percent to 3.5 percent. The high strength lyotropic liquid crystal fibers woven in the ballistic resistant sheets 32 in one example, are poly(p-phenylene-2,6-benzobisoxazole) (PBO) fibers such as those sold under the trademark name Zylon® by Toyobo Co., Ltd. of Osaka, Japan.

Figure 2:
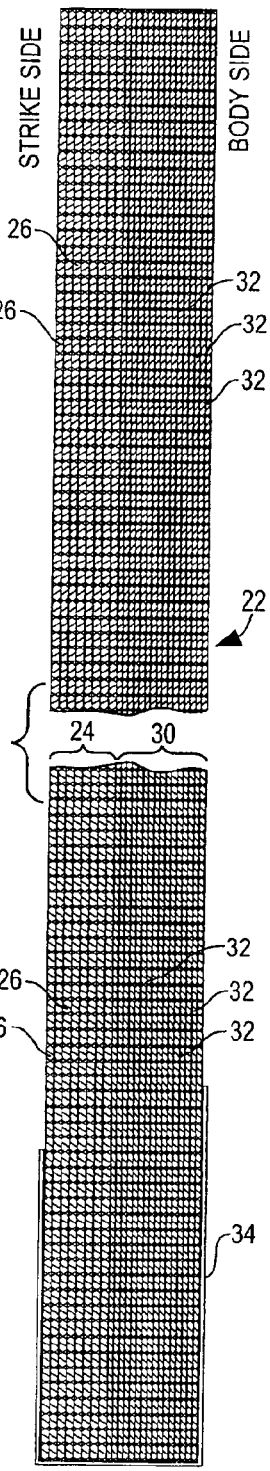
FIG. 2 is a cross sectional view taken along lines 2—2 of FIG. 1 (with stitching from panels not shown).

Referring to FIG. 2, a cross sectional view of one example of a multipurpose stab and ballistic resistant pad 22 is shown (with stitching removed) having a panel 24 of puncture resistant sheets 26 placed atop a panel 30 of ballistic resistant sheets 32. In this example, the pad 22 has eight (8) puncture resistant sheets 26 and sixteen ballistic resistant sheets 32 such that the pad 22 meets a level of stab resistance under National Institute of Justice Standard 0115.00 for Spike Level 1 and a level of ballistic resistance under National Institute of Justice Standard 0101.04 for Threat Level IIA. In this example, the pad 22 has an areal density of approximately 0.56 to 0.57 lbs/ft$^2$. The combined areal density in this example of the eight puncture resistant sheets 26 is approximately 0.21 lbs/ft$^2$ and the combined areal density of the sixteen ballistic resistant sheets 32 is approximately 0.36 lbs/ft$^2$. The pad 22 generally has a thickness of approximately 0.15 inches with the combined thickness of the puncture resistant sheets 26 approximately 0.05 inches and the combined thickness of the ballistic resistant sheets 32 approximately 0.10 inches. For further details on NIJ Standard 0115.00 reference can be made to National Institute of Justice Law Enforcement and Corrections Standards and Testing Program, "Stab Resistance of Personal Body Armor NIJ Standard—0115.00," NCJ 183652, September 2000. As will be appreciated by those skilled in the art, NIJ Standard 0101.04 for Threat Level IIA involves testing body armor against 9 millimeter (mm) 124 grain full metal jacket (FMJ) projectile at 1120 feet per second (fps) and 0.40 Smith & Wesson, 180 grain full metal jacket projectile at 1055 fps.

In another example, the multipurpose stab and ballistic resistant pad 22 has twelve (12) puncture resistant sheets 26 and twenty-two (22) ballistic resistant sheets 32 such that the pad meets a level of stab resistance under National Institute of Justice Standard 0115.00 for Spike Level 2 and a level of ballistic resistance under National Institute of Justice Standard 0101.04 for Threat Level II. In this example, the pad 22 has an areal density of approximately 0.80 lbs/ft$^2$. The combined areal density in this example of the twelve puncture resistant sheets 26 is approximately 0.31 lbs/ft$^2$ and the combined areal density of the twenty-two ballistic resistant sheets 32 is approximately 0.49 lbs/ft$^2$. The pad 22 in this example generally has a thickness of approximately 0.21 inches with the combined thickness of the puncture resistant sheets of approximately 0.07 inches and the combined thickness of the ballistic resistant sheets of approximately 0.14 inches. NIJ Standard 0101.04 for Threat Level II involves testing body armor against 9 mm, 124 grain full metal jacket projectile at 1205 fps and 0.357 Magnum, 158 grain semi jacketed hollow point projectile at 1430 fps.

In yet another example, the multipurpose stab and ballistic resistant pad 22 has fourteen (14) puncture resistant sheets 26 and twenty-eight (28) ballistic resistant sheets 32 such that the pad meets a level of stab resistance under National Institute of Justice Standard 0115.0 for Spike Level 3 and a level of ballistic resistance under National Institute of Justice Standard 0101.04 for Threat Level IIIA. In this example, the pad 22 has an areal density of approximately 0.98 lbs/ft$^2$. The combined areal density in this example of the fourteen puncture resistant sheets is approximately 0.36 lbs/ft$^2$ and the combined areal density of the twenty-eight ballistic resistant sheets is approximately 0.62 lbs/ft$^2$. The pad in this example generally has a thickness of approximately 0.26 inches with the combined thickness of the puncture resistant sheets of approximately 0.08 inches and the combined thickness of the ballistic resistant sheets of approximately 0.18 inches. NIJ Standard 1001.04 for Threat Level IIIA involves testing body armor against 9 mm SMG (sub-machine gun), 124 grain full metal jacket projectile at 1430 feet per second (fps) and .44 Magnum, 240 grain jacketed hollow point projectile at 1430 fps.

Figure 3:
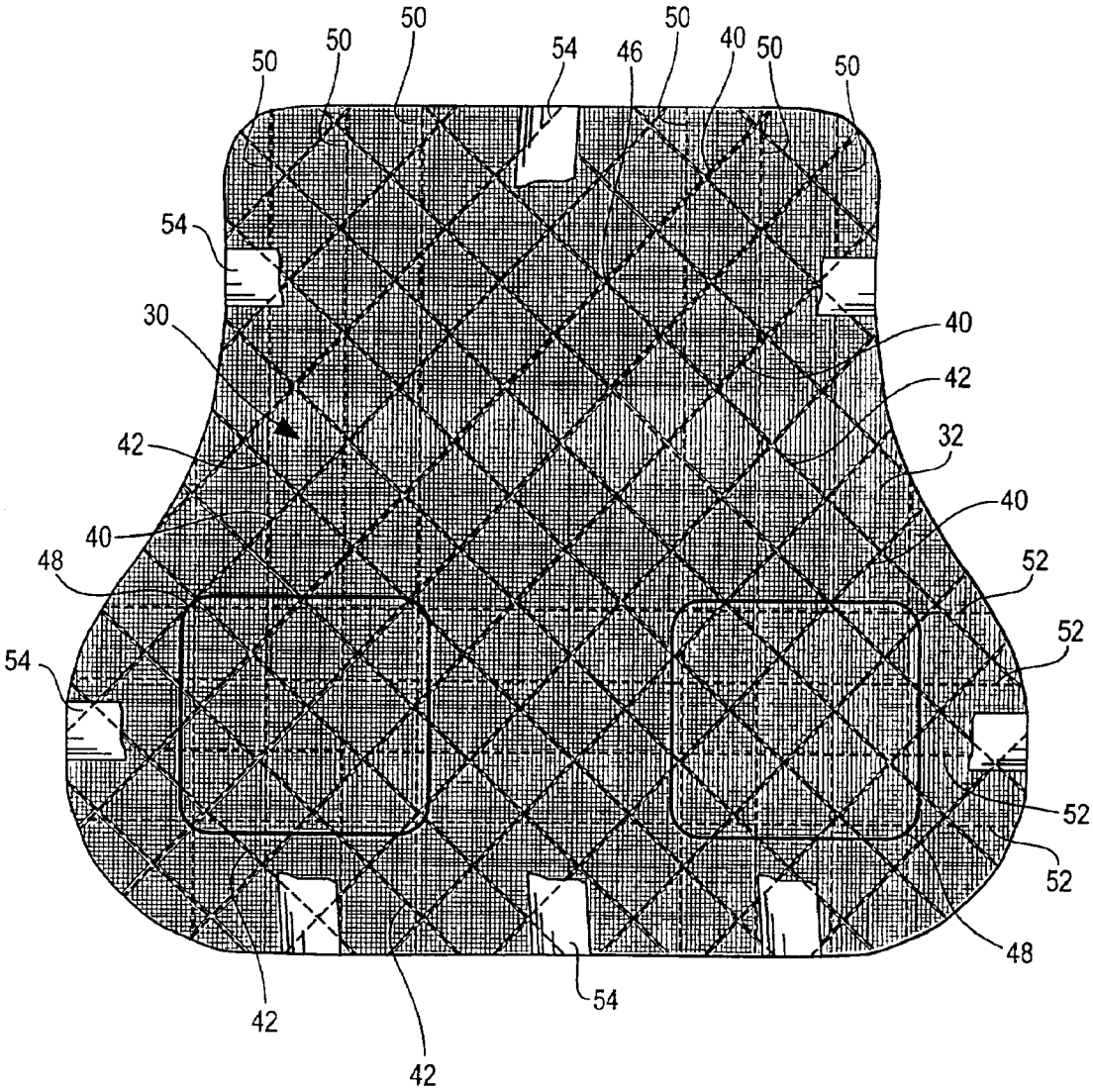
FIG. 3 is illustrative of a ballistic resistant panel.

Referring to FIG. 3, ballistic resistant panel 30 of ballistic resistant sheets 32 is shown with stitching through the ballistic resistant sheets to secure the sheets together. The ballistic resistant sheets 32 are stitched together with rows of stitches 40 of aramid thread generally aligned in one direction (such as at a 45 degree angle) and rows of stitches 42 of aramid thread generally aligned in another crossing direction (such as at a −45 degree angle) to form a quilt stitch pattern 46 through the ballistic resistant sheets 32 to secure them together. The rows of stitches 40, 42 may selectively be formed from thread of other high strength materials such as PBO. The rows of stitches 40 in one direction (as well as rows of stitches 42 in the other direction) are selectively spaced 1.0 to 4.25 inches apart from each other. The individual rows of stitches 40, 42 in both directions may selectively employ approximately four stitches per inch to secure together the sheets 32 of the ballistic panel 30. Thus, it will be understood that the quilt stitch pattern 46 of FIG. 3 is not drawn to scale but is illustrative of an exemplary quilt stitch pattern for a ballistic resistant panel. Alternatively, a box stitch pattern formed from crossing rows of stitches of high strength thread with one set of rows aligned in a substantially vertical direction (at 90 degrees) and another set of rows aligned in a substantially horizontal direction (at 0 degrees) may selectively be used to secure together the ballistic sheets of the panel as well as other known stitch pattern in the art.

The ballistic resistant sheets 32 are also stitched together with at least six vertical rows 50 of lyotropic liquid crystal polymer fiber thread and at least three horizontal rows 52 of lyotropic liquid crystal polymer fiber thread which cross the vertical rows 50 to form a box stitch pattern 48 on at least a portion of the ballistic resistant sheets 32. In the embodiment shown in FIG. 3, eight vertical rows 50 (separated in two groups of four rows) and four horizontal rows 52 proximate the lower part of the pad are provided. This "trauma trap" overstitch pattern provides additional protection to the wearer. The vertical rows of thread 50 and horizontal rows of thread in one example are made from PBO material. Alternatively, other high strength materials such as aramid fibers may be employed for the horizontal and vertical rows 50, 52 of thread. Pieces of tape 54 positioned at various locations about the edges of the ballistic resistant sheets 32 may also be selectively employed to hold the sheets 32 in place.

Referring to FIGS. 4–7, an example of three ballistic resistant sheets 32A–C are shown (without stitching) in an exploded fashion to illustrate one embodiment of alternate positioning of the weaves for the ballistic resistant sheets. Three individual ballistic sheets 32A, 32B, 32C are shown for illustrative purposes, and in one example the pattern of alternating weave alignments of the sheets may selectively repeat for ballistic resistant sheets 32 throughout the ballistic resistant panel 30. Ballistic resistant sheet 32A has a warp 60 and a weft 62 which is angularly displaced from the warp 64 and weft 66 of the next successive overlying sheet 32B. The warp 67 and the weft 68 of ballistic resistant sheet 32C (FIG. 7) are also angularly displaced from the warp 64 and the weft 66 of ballistic resistant sheet 32B (FIG. 6). The angular displacement of the warp 60 and the weft 62 of ballistic resistant sheet 32A relative to the warp 64 and the weft 66 of ballistic resistant sheet 32B ranges from 22.5 degrees to 45 degrees out of alignment.

In the example shown in FIGS. 5 and 6, the warp 60 and the weft 62 (FIG. 5) of sheet 32A are 45 degrees out of alignment relative to the respective warp 64 and weft 66 (FIG. 6) of sheet 32B. In this example, sheet 32A is woven in a plain weave with warp fibers 60 in a generally vertical direction and weft fibers 62 crossing at a 90 degree angle in a generally horizontal direction with the sheets placed in position for manufacture of the ballistic resistant panel 30. Woven sheet 32B is positioned such that the warp 64 and weft 66 of sheet 32B are angularly displaced (at 45 degrees in this example) relative to the warp 60 and weft 62 positioning in sheet 32A. Sheet 32B is woven in a plain weave with warp fibers 64 positioned generally at a 45 degree angle and weft fibers 66 crossing at a 90 degree angle and being positioned generally at a −45 degree angle. Sheet 32A is placed adjacent to sheet 32B such that sheet 32B is positioned against sheet 32B.

Ballistic resistant sheet 32C (FIGS. 4, 7) overlies ballistic resistant sheet 32B (FIG. 6) in which the warp 67 and the weft 68 of ballistic resistant sheet 32C (FIG. 7) are angularly displaced (by 45 degrees in this example) relative to the warp 64 and weft 66 of ballistic resistant sheet 32B (FIG. 6)

and are substantially in alignment with the warp 60 and weft 62 (FIG. 5) of ballistic resistant sheet 32A. In the example seen in FIG. 4, ballistic resistant sheets 32A–C are positioned adjacent to one another. Like sheet 32A (FIG. 5), successive overlying sheet 32C (FIG. 7) is positioned adjacent to sheet 32B (FIG. 6) and is woven in a plain weave with warp fibers 67 in a generally vertical direction and weft fibers 68 crossing generally at a 90 degree angle in a horizontal direction. In the embodiment of FIGS. 4–7, this warp/weft angular displacement of sheets repeats for all sheets of the ballistic resistant panel 30.

Figure 8:
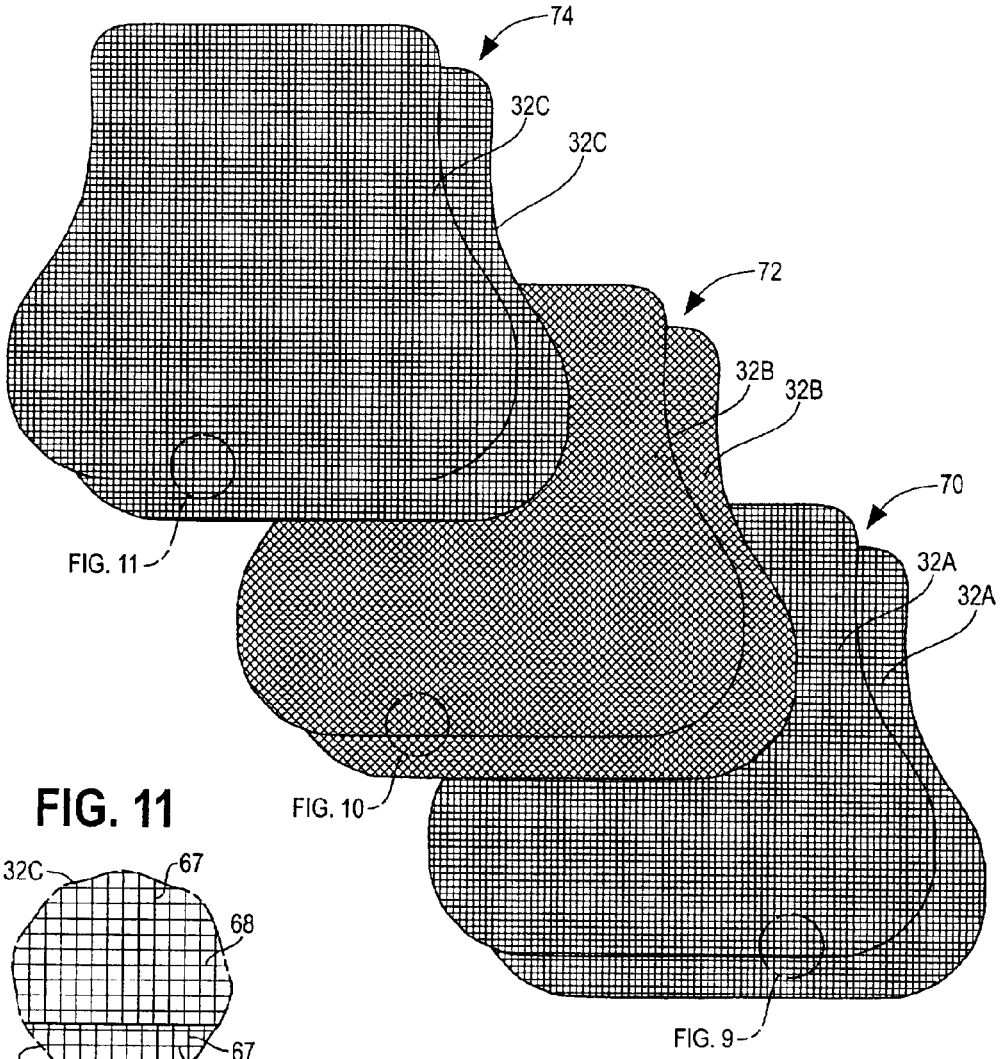
FIG. 8 is an exploded view illustrating example groups of ballistic resistant sheets (without stitching being shown) of ballistic resistant panel.
Figure 10:
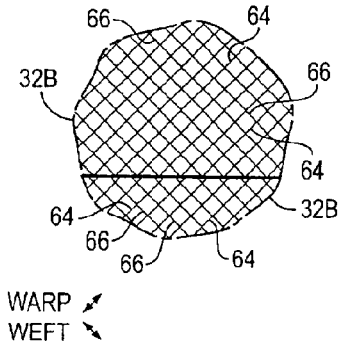
FIG. 10 is an enlarged view of a weave for a group of ballistic resistant sheets seen at the circle identified as FIG. 10 in FIG. 8.
Figure 9:
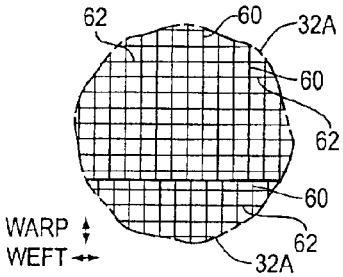
FIG. 9 is an enlarged view of a weave for a group of ballistic resistant sheets seen at the circle identified as FIG. 9 in FIG. 8.

Referring to FIGS. 8–11, an alternative arrangement of weave alignments is illustrated in an exploded fashion (FIG. 8) for groups of ballistic resistant sheets (shown without stitching). A first group 70 of two successive overlying woven ballistic resistant sheets 32A (FIGS. 8, 9) is shown having the warp 60 and weft 62 of the weave for the individual successive overlying woven ballistic resistant sheets 32A of the first group 70 being substantially in alignment to one another. A second group 72 of two successive overlying woven ballistic resistant sheets 32B (FIGS. 8, 10) is shown in which the warp 64 and weft 66 for the individual ones of the woven ballistic resistant sheets 32B of the second group 72 are substantially in alignment to one another and are angularly displaced from the warp 60 and the weft 62 of the woven ballistic resistant sheets 32A of the first group 70. In this example, the first group 70, second group 72, and third group 74 have an equal number of successive overlying woven ballistic resistant sheets, with each group having two successive overlying woven ballistic resistant sheets. In other examples, more than two successive overlying woven ballistic resistant sheets per group may selectively be employed. The angular displacement between the warp 60 and the weft 62 of the ballistic resistant sheets 32A of the first group 70 relative to the warp 64 and the weft 66 of the ballistic resistant sheets 32B of the second group 70 may selectively range from 22.5 to 45 degrees out of alignment. As seen in FIGS. 9 and 10, the sheets 32B of the second group 72 (FIG. 10) in this example are 45 degrees out of alignment relative to the sheets 32A of the first group 70 (FIG. 9).

Figure 11:
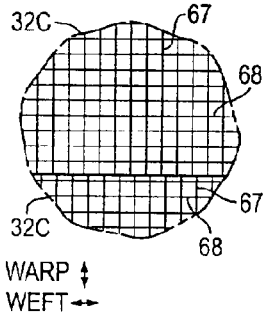
FIG. 11 is an enlarged view of a wave for a group of ballistic resistant sheets seen at the circle identified as FIG. 11 in FIG. 8.

As seen in FIGS. 8 and 11, a third group 74 of ballistic resistant sheets 32C are positioned adjacent to the second group 72 (FIG. 10) in which the second group 72 has multiple successive overlying ballistic resistant sheets 32B in which the warp 67 and the weft 68 for the individual ones of the sheets 32C of the third group 74 are substantially in alignment to one another and are angularly displaced (by 45 degrees in this example) relative to the warp 64 and the weft 66 of the woven ballistic resistant sheets 32B of the second group 72. The warp 67 and the weft 68 of the overlying woven ballistic resistant sheets 32C of the third group 74 (FIG. 8, 11) are substantially in alignment with the warp 60 and the weft 62 of the overlying woven ballistic resistant sheets 32A of the first group 70. This pattern of weave angular displacement from one group to the next may selectively continue throughout the ballistic resistant panel. Alternatively, the individual sheets (FIGS. 4–7) or groups of sheets (FIGS. 8–11) may have the angular displacement of weaves in any various arrangement between successive sheets or groups in the panel.

Figure 12:
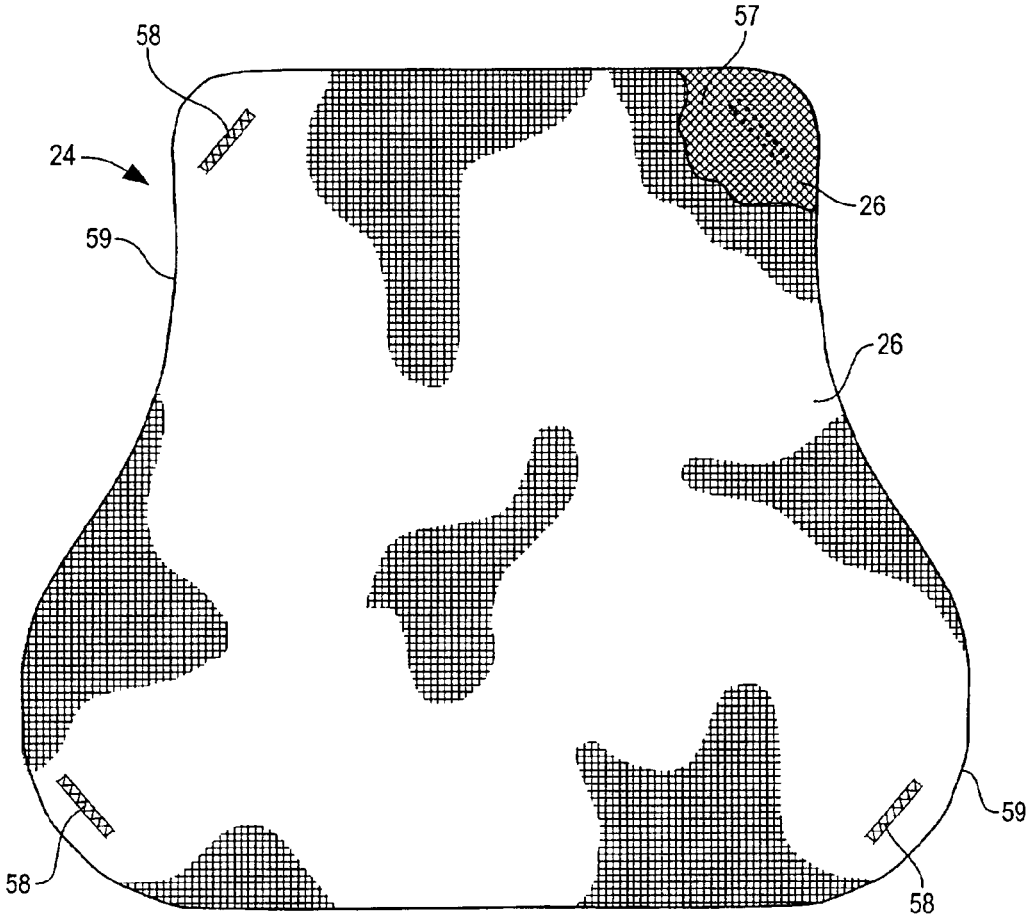
FIG. 12 is illustrative of a puncture resistant panel.
Figure 13:
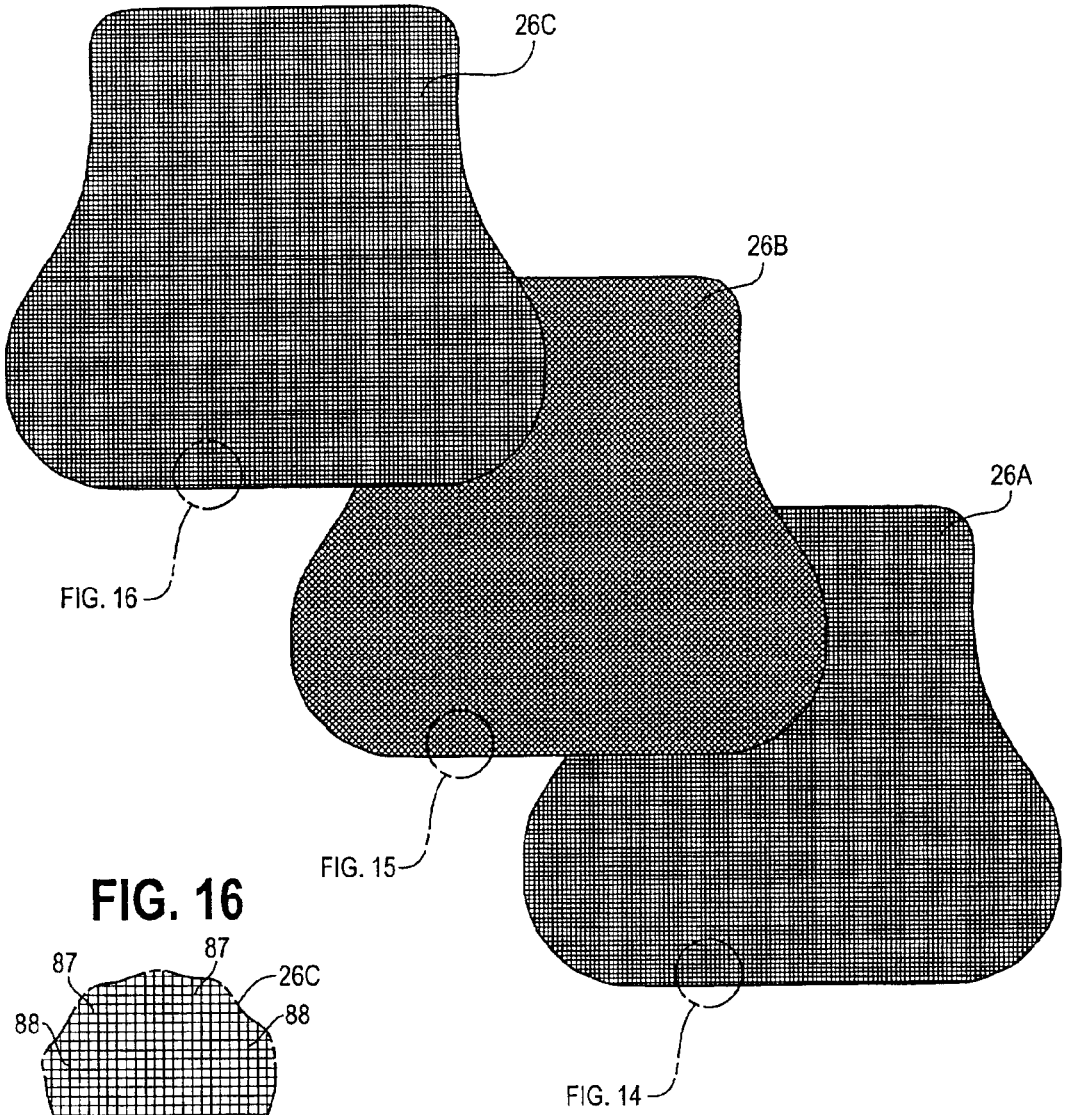
FIG. 13 is an exploded view illustrating example puncture resistant sheets (without stitching being shown) of puncture resistant panel.
Figure 16:
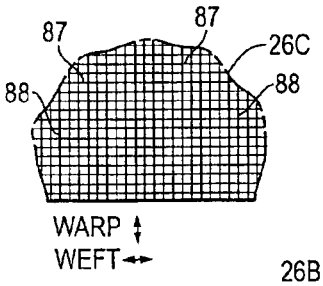
FIG. 16 is an enlarged view of a weave for a puncture resistant sheet seen at the circle identified as FIG. 16 in FIG. 10.
Figure 15:
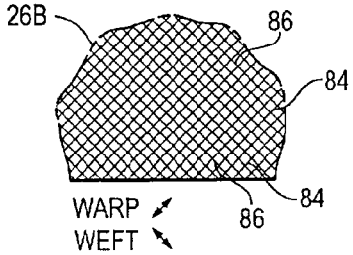
FIG. 15 is an enlarged view of a weave for a puncture resistant sheet seen at the circle identified as FIG. 15 in FIG. 10.
Figure 14:
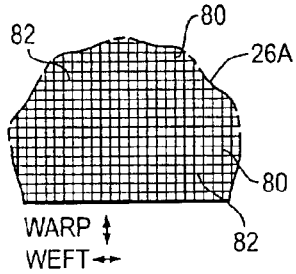
FIG. 14 is an enlarged view of a weave of a puncture resistant sheet seen at the circle identified as FIG. 10 in FIG. 10.

Referring to FIG. 12, panel 24 of puncture resistant sheets 26 is shown having bar tac stitches 58 positioned proximate periphery 59 of the puncture resistant sheets 26 to secure them together. The bar tac stitches 58 may selectively be formed of aramid fiber thread and are generally approximately one inch in length and generally no longer than two inches in length. A portion 57 of FIG. 12 is broken away to illustrate the thread of the bar tac stitches is stitched through the puncture resistant sheets 26 to secure them together in the puncture resistant panel 24.

Referring to FIGS. 13–16, an example of three puncture resistant sheets 26A, 26B, 26C are shown in an exploded fashion to illustrate one embodiment of alternate positioning of the weaves for the puncture resistant sheets. FIGS. 13–16 are representations of example puncture resistant sheets, and as discussed above the puncture resistant sheets have a tighter weave of fibers (of at least 60×60 fibers per inch) relative to the ballistic sheets which have a weave less than 60×60 fibers per inch (such as between to 22 to 27 warp and 22 to 27 weft fibers per inch). Three individual puncture resistant sheets 26A, 26B, 26C are shown for illustrative purposes, and in one example the pattern of alternating weave alignments of the sheets or groups of sheets may selectively repeat for the puncture resistant sheets 26 throughout the puncture resistant panel 24. Alternatively, the individual puncture resistant sheets (FIGS. 13–16) or groups of puncture resistant sheets (FIGS. 17–20) may have the angular displacements of weaves in many different various increments between successive sheets or groups of sheets in puncture panel 24.

Puncture resistant sheet 26A (FIGS. 13–16) has a warp of aramid warp fibers 80 and a weft of aramid weft fibers 82 which are angularly displaced from the respective aramid warp fibers 84 and aramid weft fibers 86 of the next successive overlying puncture resistant sheet 26B. The warp fibers 84 and the weft fibers 86 of puncture resistant sheet 26B are also angularly displaced from the aramid warp fibers 87 and the aramid weft fibers 88 of puncture resistant sheet 26C. The angular displacement of the aramid warp fibers 80 and the aramid weft fibers 82 of puncture resistant sheet 26A relative to the warp fibers 84 and the weft fibers 86 of puncture resistant sheet 26B ranges from 22.5 degrees to 45 degrees out of alignment. In the example shown in FIGS. 13 and 14, the warp 80 and the weft 82 (FIG. 14) of puncture resistant sheet 26A are 45° degrees out of alignment relative to the respective warp 84 and weft 86 (FIG. 15) of sheet 26B. In this example, sheet 26A is woven in a plain weave with warp fibers 80 in a generally vertical direction and weft fibers 82 crossing at a 90° angle in a generally horizontal direction with the puncture resistant sheets placed in position for manufacture of the puncture resistant panel 24. Woven puncture resistant sheet 26B is positioned such that the warp 84 and weft 86 of sheet 26B are angularly displaced (at 45 degrees in this example) relative to the warp 80 and weft 82 positioning of sheet 26A. Sheet 26B is woven in a plain weave with warp fibers 84 positioned generally at a 45 degree angle and weft fibers crossing at a 90 degree angle and being positioned generally at a −45 degree angle. Puncture resistant sheet 26B is placed adjacent to puncture resistant sheet 26A such that sheet 26B is positioned against sheet 26A.

Puncture resistant sheet 26C (FIGS. 13, 16) overlies puncture resistant sheet 26B (FIG. 15) in which the aramid warp fibers 87 and the aramid weft fibers 88 of puncture resistant sheet 26C (FIG. 16) are angularly displaced (by 45 degrees in this example) relative to the warp fibers 84 and weft fibers 86 of puncture resistant sheet 26C (FIG. 15) and are substantially in alignment with the warp fibers 80 and weft fibers 82 (FIG. 14) of puncture resistant sheet 26A. In the example seen in FIG. 13, puncture resistant sheets 26A–C are positioned adjacent to one another. Like puncture resistant sheet 26A (FIG. 14), puncture resistant sheet 26C (FIG. 16) is positioned adjacent to sheet 26B (FIG. 15) and is woven in a plain weave with warp fibers 87 in a generally vertical direction and weft fibers 88 crossing generally at a 90 degree angle in a horizontal direction. In the embodiment of FIGS. 13–16, this warp/weft angular displacement of puncture resistant sheets 26 repeats for all sheets of the puncture resistant panel 24.

Figure 17:
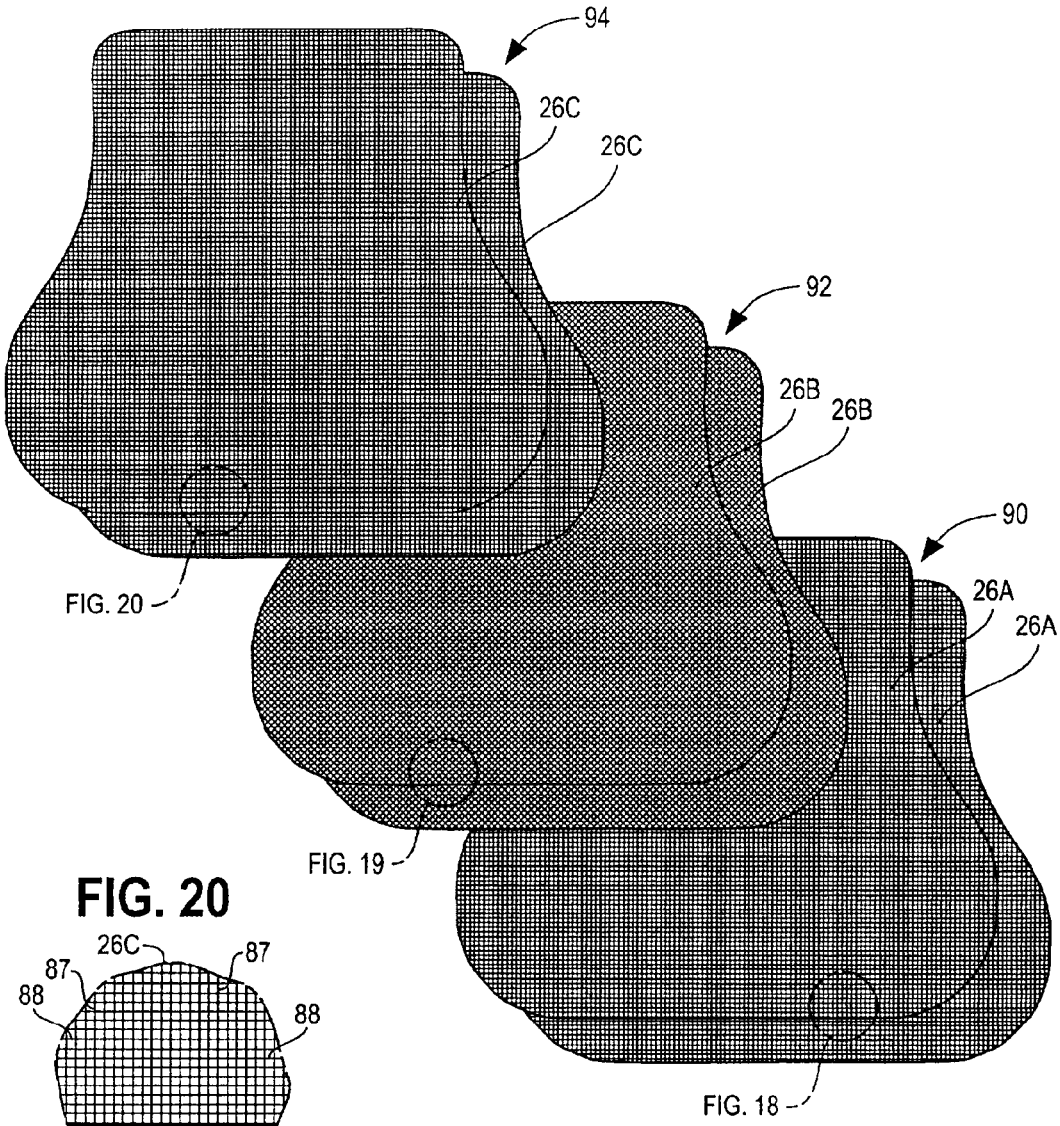
FIG. 17 is an exploded view illustrating example groups of puncture resistant sheets (without stitching being shown) of puncture resistant panel.
Figure 19:
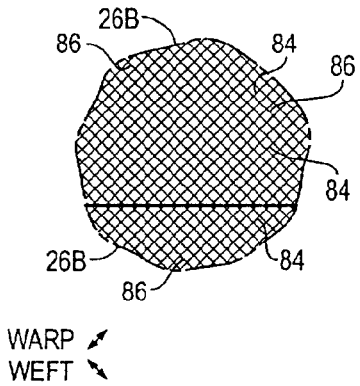
FIG. 19 is an enlarged view of a weave for a group of puncture resistant sheets seen at the circle identified as FIG. 19 in FIG. 17.
Figure 18:
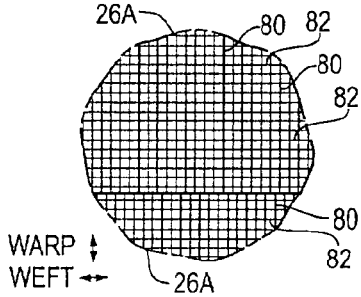
FIG. 18 is an enlarged view of a weave for a group of puncture resistant sheets seen at the circle identified as FIG. 18 in FIG. 17.

Referring to FIGS. 17–20, an alternative arrangement of weave alignments is illustrated in an exploded fashion (FIG. 17) for groups of puncture resistant sheets (shown without bar tac stitching). A first group 90 of two successive overlying woven puncture resistant sheets 26A (FIGS. 17, 18) is shown having the aramid warp fibers 80 and aramid weft fibers 82 of the weave for the individual successive overlying woven puncture resistant sheets 26A of the first group 90 being substantially in alignment to one another. A second group 92 of two successive overlying woven puncture resistant sheets 26B (FIGS. 17, 19) is shown in which the aramid warp fibers 84 and aramid weft fibers 86 for the individual ones of the woven puncture resistant sheets 26B of the second group 92 are substantially in alignment to one another and are angularly displaced from the warp 80 and the weft 82 of the woven puncture resistant sheets 26A of the first group 90. In this example, the first group 90, second group 92, and third group 94 have an equal number of successive overlying woven puncture resistant sheets, with each group having two successive overlying woven puncture resistant sheets. In other examples, more than two successive overlying woven puncture resistant sheets per group may selectively be employed. The angular displacement between the aramid warp fibers 80 and the aramid weft fibers 82 of the puncture resistant sheets 26A of one group relative to the warp 84 and the weft 86 of the puncture resistant sheets of another successive group may selectively range from 22.5 to 45 degrees out of alignment. As seen in FIGS. 18 and 19, the sheets 26 of the second group 92 (FIG. 19) are 45 degrees out of alignment relative to the sheets 26A of the first group 90 (FIG. 18).

Figure 20:
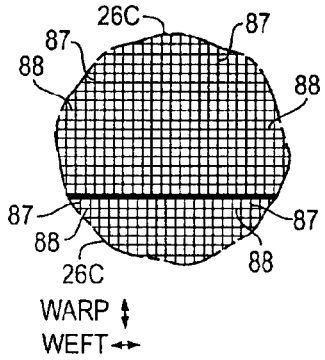
FIG. 20 is an enlarged view of a weave for a group of puncture resistant sheets seen at the circle identified as FIG. 20 in FIG. 17.

As seen in FIGS. 17 and 20, a third group 94 of puncture resistant sheets 26C are positioned adjacent to the second group 92 (FIG. 19) in which the second group 92 has multiple successive overlying puncture resistant sheets 26B in which the aramid warp fibers 87 and the aramid weft fibers 88 for the individual ones of the puncture resistant sheets 26C of the third group 94 are substantially in alignment to one another and are angularly displaced (by 45 degrees in this example) relative to the aramid warp fibers 84 and the aramid weft fibers 86 of the woven puncture resistant sheets 26B of the second group 92. The warp fibers 87 and the weft fibers 88 of the overlying woven puncture resistant sheets 26C of the third group 94 (FIGS. 17, 20) are substantially in alignment with the warp fibers 80 and the weft fibers 82 of the overlying woven puncture resistant sheets 26A of the first group 90.

A method of making a multipurpose ballistic and stab resistant garment is provided. The method comprises the steps of (a) providing puncture resistant sheets of woven aramid fibers to overly one another in which the puncture resistant sheets are formed from a weave of at least 60 aramid warp fibers per inch and at least 60 aramid web fibers per inch, and (b) placing a ballistic resistant sheets of woven lyotropic liquid crystal polymer fiber on at least one side of the puncture resistant sheets. The step of providing the ballistic resistant sheets to have a warp of less than 60 lyotropic liquid crystal polymer fibers per inch and a weft of less than 60 lyotropic liquid crystal polymer fibers per inch is performed. In one example, the lyotropic liquid crystal polymer fibers are selectively provided to have one or more of: (a) a filament denier of 1.5 dpf; (b) a density ranging from 1.54 to 1.56 grams per cubic centimeter; (c) a tensile strength of 42 grams per denier; (d) a tensile modulus ranging from 1300 to 2000 grams per denier; (e) a decomposition temperature in air of 650 degree centigrade; and (f) a break elongation ranging from 2.5% to 3.5%. The lyotropic liquid crystal polymer fiber may selectively be formed from poly (p-phenylene-2,6-benzobisoxazole). The method includes the step of providing the aramid fibers of the puncture resistant sheets to have at least one of: (a) filaments which provide from 50 million to 90 million filament crossovers per square inch; (b) a break elongation of greater than 3.0%; and (c) a tenacity of greater than 23.8 grams per denier. The step of positioning the puncture resistant sheets at a strike side of the garment relative to the ballistic resistant sheets is also performed.

In one embodiment of the method, the respective warps and wefts for the ballistic resistant sheets in the ballistic resistant panel are angularly displaced relative to one another. The angular displacement of weave arrangements between successive sheets may randomly vary or may follow a consistent pattern throughout the ballistic resistant panel. The angular displacement of successive sheets or groups of sheets may range from 22.5 to 45 degrees out of alignment. The step of angularly displacing the warp and weft of one ballistic resistant sheet relative to the warp and the weft of a second ballistic resistant sheet overlying the one ballistic resistant sheet is performed. The warp and weft of one ballistic resistant sheet is angularly displaced relative to the warp and weft of another successive ballistic resistant sheet whereby the angular displacement selectively ranges from 22.5 degree to 45 degree of angular displacement out of alignment. A third ballistic resistant sheet is provided to overly the second ballistic resistant sheet and the warp and the weft of the third ballistic resistant sheet is angularly displaced relative to the warp and the weft of the second ballistic resistant sheet. The step of substantially aligning the warp and the weft of a third ballistic resistant sheet with the warp and the weft of a first ballistic resistant sheet is performed. This pattern may be continued for the sheets throughout the ballistic panel. The ballistic resistant sheets of the ballistic resistant panel are positioned to be adjacent to one another such that the warps and the wefts of successive sheets adjacent to one another are angularly displaced relative to one another throughout the ballistic resistant panel.

An alternative method may selectively be performed whereby groups of two or more ballistic resistant sheets are utilized in which the respective warps and wefts of adjacent groups are angularly displaced relative to one another. The method comprises the step of providing the ballistic resistant sheets with a first group of at least two successive overlying woven ballistic resistant sheets, in which the warp and the weft for individual ones of the successive overlying woven ballistic resistant sheets of the first group are substantially in alignment to one another. A second group of at least another two successive overlying woven ballistic resistant sheets is provided in which the warp and the weft for individual ones of the woven ballistic resistant sheets of the second group are substantially in alignment to one another and are angularly displaced from the warp and the weft of the woven ballistic resistant sheets of the first group. In one example the first group and the second group are provided to have an equal number of successive overlying ballistic resistant sheets, such as two sheets per group. The step of providing an angular displacement between the sheets of one group relative to the ballistic resistant sheets of a next successive group to range from 22.5 to 45 degree out of alignment is performed.

The method may selectively comprise the step of providing a third group of ballistic resistant sheets positioned adjacent to the second group, in which the third group has at least two successive overlying woven ballistic resistant sheets, and in which the warp and the weft for individual ones of the woven ballistic resistant sheets of the third group are substantially in alignment to one another and are angularly displaced relative to the warp and the weft of the ballistic resistant sheets of the second group. The warp and the weft for the sheets of the third group are provided to be substantially in alignment with the warp and the weft of the overlying sheets of the first group. In one example, each of the groups of ballistic resistant sheets in the ballistic resistant panel have an equal number of successive overlying woven ballistic resistant sheets. The step of stitching the ballistic resistant sheets of the ballistic resistant panel together with rows of stitches of aramid thread generally aligned in one direction and with rows of stitches of aramid thread generally aligned in another crossing direction to form a quilt stitch pattern may selectively be performed. This pattern of angularly displacing the weaves of successive groups of sheets may selectively continue throughout the ballistic resistant panel. Additionally, the step of stitching the ballistic resistant sheets of the ballistic resistant panel together with at least six vertical rows of lyotropic liquid crystal polymer thread and with at least three horizontal rows of lyotropic liquid crystal polymer fiber thread such that the horizontal rows and the vertical rows form a box stitch pattern on a portion of the ballistic resistant sheets may be performed.

The multipurpose ballistic and stab resistant pad is also provided with a puncture resistant panel. The step of securing the puncture resistant sheets of the puncture resistant panel together with bar tac stitches positioned proximate a periphery of the woven puncture resistant sheets is performed. The puncture resistant sheets of the puncture resistant panel are non-invasively held to the ballistic resistant sheets of the ballistic resistant panel. The puncture resistant sheets may selectively be held to the ballistic resistant sheets with tape. The step of covering the puncture resistant sheets and the ballistic resistant sheets with a pad cover formed of water proof and moisture vapor permeable material is also performed.

The method may also selectively have the step of angularly displacing respective warps and wefts of individual puncture resistant sheets in the puncture resistant panel. The step of angularly displacing the aramid warp fibers and aramid weft fibers of one puncture resistant sheet relative to the aramid warp fibers and aramid weft fibers of a second puncture resistant sheet which overlies the one puncture resistant sheet is performed. In one example the method comprises the step of angularly displacing the fibers of one puncture resistant sheet relative to the fibers of another successive puncture resistant sheet to range from 22.5 to 45 degree out of alignment. The steps of angularly displacing the aramid warp fibers and aramid weft fibers of a third puncture resistant sheet relative to the aramid warp fibers and aramid weft fibers of the second puncture resistant sheet and substantially aligning the aramid warp fibers and aramid weft fibers of the third puncture resistant sheet with the aramid warp fibers and aramid weft fibers of the first puncture resistant sheet may selectively be performed.

An alternative method of angularly displacing the weaves of groups of individual puncture resistant sheets in the puncture resistant panel may also be performed. In this example, the step of providing the puncture resistant sheets with a first group of at least two successive overlying puncture resistant sheets, in which the aramid warp fibers and aramid weft fibers for individual ones of the successive overlying puncture resistant sheets of the first group are substantially in alignment to one another may be accomplished. A second group is provided having at least two other successive overlying puncture resistant sheets. The aramid warp fibers and aramid weft fibers for individual puncture resistant sheets of the second group are substantially in alignment to one another and are angularly displaced from the aramid warp fibers and aramid weft fibers of the puncture resistant sheets of the first group. In one example, each of the groups of puncture resistant sheets in the puncture resistant panel have an equal number of successive overlying puncture resistant sheets. The step of establishing the angular displacement between the aramid warp fibers and the aramid weft fibers of the puncture resistant sheets of one group relative to the aramid warp fibers and aramid weft fibers of the puncture resistant sheets of another group of puncture resistant sheets to range from 22.5 to 45 degrees out of alignment is performed.

The method comprises the step of positioning a third group of puncture resistant sheets to be adjacent to the second group of puncture resistant sheets, in which the third group has at least two successive overlying puncture resistant sheets. The step of positioning the aramid warp fibers and aramid weft fibers for individual puncture resistant sheets of the third group to be substantially in alignment to one another is accomplished. The aramid warp fibers and aramid weft fibers of the puncture resistant sheets of the third group are angularly displaced relative to the aramid warp fibers and aramid weft fibers of the puncture resistant sheets of the second group. The step of substantially aligning the aramid warp fibers and aramid weft fibers of the overlying puncture resistant sheets of the third group with the aramid warp fibers and aramid weft fibers of the overlying puncture resistant sheets of the first group is accomplished. Each of the groups of puncture resistant sheets in the puncture resistant panel may selectively be provided with an equal number of successive overlying puncture resistant sheets, for instance two sheets per group.

The method of making a multipurpose ballistic and stab resistant garment may selectively include the step of forming a multipurpose stab and ballistic resistant pad which meets a level of stab resistance under National Institute of Justice Standard 0115.004 for various Spike Levels and a level of ballistic resistance under National Institute of Justice Standard 0101.04 for various Threat Levels. In one example the step of forming a multipurpose ballistic and stab resistant pad which comprises puncture resistant sheets and ballistic resistant sheets such that the pad meets a level of stab resistance under National Institute of Justice Standard 0115.00 for Spike Level 1 and a level of ballistic resistance under National Institute of Justice Standard 0101.04 for Threat Level IIA is performed. In this example, the pad may be selectively formed with no more than eight puncture resistant sheets and no more than 16 ballistic resistant sheets. The step of providing the pad with an areal density not greater than 0.56 to 0.57 lbs/ft$^2$ is performed. The pad in this example may be selectively provided with a combined areal density for the puncture resistant sheets to be no greater than 0.21 lbs/ft$^2$ and a combined areal density for the ballistic resistant sheets to be no greater than 0.36 lbs/ft$^2$. In this example, the step of providing the pad with a thickness not greater than 0.15 inches is performed whereby the pad has a combined thickness for the puncture resistant sheets to be no greater than 0.05 inches and the combined thickness of the ballistic resistant sheets is not greater than 0.10 inches.

Alternatively, a multipurpose stab and ballistic resistant pad may be formed in which the pad meets a level of stab resistance under National Institute of Justice Standard 0115.00 for Spike Level 2 and a level of ballistic resistance under National Institute of Justice Standard 0101.04 for Threat Level II. In this example, the step of forming the pad with no more than 12 puncture resistant sheets and no more than 22 ballistic resistant sheets may selectively be performed. The step of providing the pad with an areal density not greater than 0.80 lbs/ft$^2$ is performed whereby the pad has a combined areal density for the puncture resistant sheets to be no greater than 0.31 lbs/ft$^2$ and a combined areal density for the ballistic resistant sheets to be no greater than 0.49 lbs/ft$^2$. The step of providing the pad in this example with a thickness not greater than 0.21 inches may selectively be performed whereby the thickness for the plurality of puncture resistant sheets is not greater than 0.07 inches and a combined thickness of the ballistic resistant sheets is not greater than 0.14 inches.

The step of forming a multipurpose stab and ballistic resistant pad that meets a level of stab resistance under National Institute of Justice Standard 0115.00 for Spike Level 3 and a level of ballistic resistance under National Institute of Justice Standard 0101.04 for Threat Level IIIA is also performed. In this example, the step of forming the pad with no more than 14 puncture resistant sheets and no more than 28 ballistic resistant sheets may selectively be performed. In this example, the pad is provided with an areal density not greater than 0.98 lbs/ft$^2$ and the step of providing the pad with a combined areal density for the puncture resistant sheets to be no greater than 0.36 lbs/ft$^2$ and the combined areal density for the ballistic resistant sheets to be not greater than 0.62 lbs/ft$^2$ may selectively be accomplished. The method may include the step of providing the pad with a thickness not greater than 0.26 inches. The pad may be provided with a combined thickness for the puncture resistant sheets to be no greater than 0.08 inches and a combined thickness for the ballistic resistant sheets to be no greater than 0.18 inches in this example.

While a detailed description of preferred embodiments of this invention has been given, it should be appreciated that many variations can be made thereto without departing from the scope of the invention as set forth by the appended claims.

What is claimed is:

1. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch;

a plurality of ballistic resistant sheets of woven lyotropic liquid crystal polymer fiber having a warp and a weft in which the warp and weft of one ballistic resistant sheet are angularly displaced from the warp and the weft of a second ballistic resistant sheet overlying the one ballistic resistant sheet in which the angular displacement of the warp and the weft of the at least one ballistic resistant sheet relative to the warp and the weft of the second ballistic resistant sheet ranges from 22.5 degrees to 45 degrees out of alignment; and at least a third ballistic resistant sheet overlying the second ballistic resistant sheet, in which the warp and the weft of the third ballistic resistant sheet are angularly displaced relative to the warp and the weft of the second ballistic resistant sheet and are substantially in alignment with the warp and the weft of the first ballistic resistant sheet.

2. The garment of claim 1 in which the warp of the ballistic resistant sheets is of less than 60 lyotropic liquid crystal polymer fibers per inch and the weft is less than 60 lyotropic liquid crystal polymer fibers per inch.

3. The garment of claim 2 in which the lyotropic liquid crystal polymer fiber has at least one of: a) a filament denier of 1.5 dpf; b) a density ranging from 1.54 to 1.56 g/cm$^3$; c) a tensile strength of 42 grams/denier; d) a tensile modulous ranging from 1300 to 2000 grams/denier; e) a decomposition temperature in air of 650 degrees centigrade; and f) a break elongation ranging from 2.5 percent to 3.5 percent.

4. The garment of claim 2 in which the lyotropic liquid crystal polymer fiber is formed from poly (p-phenylene-2, 6-benzobisoxazole).

5. The garment of claim 4 in which the aramid fibers of the puncture resistant sheets have at least one of: a) filaments which provide from 50,000,000 to 90,000,000 filament crossovers per square inch; b) a break elongation of greater than 3.0 percent; and c) a tenacity of greater than 23.8 grams per denier.

6. The garment of claim 5 in which the puncture resistant sheets are positioned at a strike side of the garment relative to the ballistic resistant sheets.

7. The garment of claim 1 in which the first, second and third ballistic resistant sheets are positioned successively adjacent to one another such that the first ballistic resistant sheet is adjacent to the second ballistic resistant sheet and the second ballistic resistant sheet is adjacent to the third ballistic resistant sheet.

8. The garment of claim 1 in which the ballistic resistant sheets are stitched together with rows of stitches of aramid thread generally aligned in one direction and rows of stitches of aramid thread generally aligned in another crossing direction forming a quilt stitch pattern.

9. The garment of claim 1 in which the plurality of puncture resistant sheets are secured together by a plurality of bar tac stitches positioned proximate a periphery of the puncture resistant sheets.

10. The garment of claim 1 in which the plurality of puncture resistant sheets and the plurality of ballistic resistant sheets are non-invasively held to each other.

11. The garment of claim 10 further comprising tape to hold the puncture resistant sheets and ballistic resistant sheets to each other.

12. The garment of claim 10 further comprising a pad cover constructed at least in part of waterproof and moisture vapor permeable material to cover and enclose the puncture resistant sheets and the ballistic resistant sheets.

13. The garment of claim 1 in which the puncture resistant sheets comprise at least two successive overlying sheets in which the aramid warp fibers and the aramid weft fibers of one puncture resistant sheet are angularly displaced from the aramid warp fibers and the aramid weft fibers of a second puncture resistant sheet overlying the one puncture resistant sheet.

14. The garment of claim 13 in which the angular displacement of the aramid warp fibers and aramid weft fibers of the at least one puncture resistant sheet relative to the aramid warp fibers and aramid weft fibers of the second puncture resistant sheet ranges from 22.5 to 45 degrees out of alignment.

15. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000,000 to 90,000,000 filament crossovers per square inch; b) a break elongation of greater than 3.0 percent; and c) a tenacity of greater than 23.8 grams per denier; and a plurality of ballistic resistant sheets of woven lpotropic liquid crystal polymer fiber formed from poly (p-phenylene-2,6-benzobisoxazole), the ballistic resistant sheets have a warp of less than 60 lyotropic liquid crystal polymer fibers per inch and a welt of less than 60 lyotropic liquid crystal polymer fibers per inch in which the plurality of ballistic resistant sheets comprises a first group of at least two successive overlying woven ballistic resistant sheets, in which the warp and the weft for individual ones of the successive overlying woven ballistic resistant sheets of the first group are substantially in alignment to one another, and further comprises a second group of at least another two successive overlying woven ballistic resistant sheets, in which the warp and the weft for individual ones of the woven ballistic resistant sheets of the second group are substantially in alignment to one another and are angularly displaced from the warp and the weft of the woven ballistic resistant sheets of the first group.

16. The garment of claim 15 in which the first group and the second group have an equal number of successive overlying woven ballistic resistant sheets.

17. The garment of claim 16 in which the first group and the second group each have two successive overlying woven ballistic resistant sheets.

18. The garment of claim 15 in which the angular displacement between the warp and the weft of the ballistic resistant sheets of the first group relative to the warp and the weft of the ballistic resistant sheets of the second group ranges from 22.5 to 45 degrees out of alignment.

19. The garment of claim 18 further comprising a third group of ballistic resistant sheets positioned adjacent to the second group in which the third group has at least two successive overlying woven ballistic resistant sheets in which the warp and the weft for individual ones of the woven ballistic resistant sheets of the third group are substantially in alignment to one another and are angularly displaced relative to the warp and the weft of the woven ballistic resistant sheets of the second group.

20. The garment of claim 19 in which the warp and the weft of the overlying woven ballistic resistant sheets of the third group are substantially in alignment with the warp and the weft of the overlying woven ballistic resistant sheets of the first group.

21. The garment of claim 19 in which the first group, second group and third group have an equal number of successive overlying woven sheets.

22. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000,000 to 90,000,000 filament crossovers per square inch; b) a break elongation of greater than 3.0 percent; and c) a tenacity of greater than 23.8 grams per denier; and a plurality of ballistic resistant sheets of woven lyotropic liquid crystal polymer fiber formed from poly (p-phenylene-2,6-benzobisoxazole), the ballistic resistant sheets have a warp of less than 60 lyotropic liquid crystal polymer fibers per inch and a weft of less than 60 lyotropic liquid crystal polymer fibers per inch, the ballistic resistant sheets comprise at least two successive overlying sheets in which the warp and weft of one ballistic resistant sheet are angularly displaced from the warp and the weft of a second ballistic resistant sheet overlying the one ballistic resistant sheet and in which the ballistic resistant sheets are stitched together with at least six vertical rows of lyotropic liquid crystal polymer fiber thread and at least three horizontal rows of lyotropic liquid crystal polymer fiber thread which cross the vertical rows to form a box stitch pattern on at least a portion of the plurality of ballistic resistant sheets.

23. A multipurpose stab and ballistic resistant garment comprising:

a plurality of puncture resistant sheets of woven aramid fiber in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000,000 to 90,000,000 filament crossovers per square inch; b) a break elongation of greater than 3.0 percent; and c) a tenacity of greater than 23.8 grams per denier; and a plurality of ballistic resistant sheets of woven lyotropic liquid crystal polymer fiber formed from poly (p-phenylene-2,6-benzobisoxazole), the ballistic resistant sheets have a warp of less than 60 lyotropic liquid crystal polymer fibers per inch and a weft of less than 60 lyotropic liquid crystal polper fibers per inch, the ballistic resistant sheets comprise at least two successive overlying sheets in which the warp and the weft of one ballistic resistant sheet are angularly displaced from the warp and the weft of a second ballistic resistant sheet overlying the one ballistic resistant sheet, in which the puncture resistant sheets are secured by a plurality of bar tac stitches positioned proximate a periphery of the puncture resistant sheets and are formed of aramid fiber thread and are no longer than two inches in length.

24. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000,000 to 90,000,000 filament crossovers per square inch; b) a break elongation of greater than 3.0 percent; and c) a tenacity of greater than 23.8 grams per denier, the puncture resistant sheets comprise at least two successive overlying sheets in which the aramid warp fibers and the aramid weft fibers of one puncture resistant sheet are angularly displaced from the aramid warp fibers and the aramid weft fibers of a second puncture resistant sheet overlying the one puncture resistant sheet, the angular displacement of the aramid warp fibers and aramid weft fibers of the one puncture resistant sheet relative to the aramid warp fibers and aramid weft fibers of the second puncture resistant sheet ranges from 22.5 to 45 degrees out of alignment, the puncture resistant sheets comprise at least a third puncture resistant sheet overlying the second puncture resistant sheet in which the aramid warp fibers and aramid weft fibers of the third puncture resistant sheet are angularly displaced relative to the aramid warp fibers and aramid weft fibers of the second puncture resistant sheet and are substantially in alignment with the aramid warp fibers and aramid weft fibers of the first puncture resistant sheet; and a plurality of ballistic resistant sheets of woven lytropic liquid crystal polymer fiber formed from poly (p-phenylene-2,6-benzobisoxazole), the ballistic resistant sheets have a warp of less than 60 lytropic liquid crystal polymer fibers per inch and a weft of less than 60 lyotropic liquid crystal polymer fibers per inch, the ballistic resistant sheets comprise at least two successive overlying sheets in which the warp and the weft of one ballistic resistant sheet are angularly displaced from the warp and the weft of a second ballistic resistant sheet overlying the one ballistic resistant sheet.

25. The garment of claim 24 in which the first, second and third puncture resistant sheets are positioned adjacent to one another.

26. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000, 000 to 90,000,00 filament crossovers per square inch; b) a break elongation of greater than 3.0 percent; and c) a tenacity of greater than 23.8 grams per denier, the plurality of puncture resistant sheets comprise a first group of at least two successive overlying puncture resistant sheets, in which the aramid warp fibers and the aramid weft fibers for individual ones of the successive overlying puncture resistant sheets of the first group are substantially in alignment to one another, and further comprise a second group of at least another two successive overlying puncture resistant sheets, in which the aramid warp fibers and the aramid weft fibers for individual ones of the puncture resistant sheets of the second group are substantially in alignment to one another and are angularly displaced from the aramid warp fibers and aramid weft fibers of the puncture resistant sheets of the first group; and a plurality of ballistic resistant sheets of woven lyotropic liquid crystal polymer fiber formed from poly (p-phenylene-2,6-benzobisoxazole), the ballistic resistant sheets have a warp of less than 60 lyotropic liquid crystal polymer fibers per inch and a weft of less than 60 lyotropic liquid crystal polymer fibers per inch.

27. The garment of claim 26 in which the first group and second group have an equal number of successive overlying puncture resistant sheets.

28. The garment of claim 27 in which the first group and the second group each have two successive overlying puncture resistant sheets.

29. The garment of claim 28 in which the angular displacement between the aramid warp fibers and the aramid weft fibers of the puncture resistant sheets of the first group relative to the aramid warp fibers and aramid weft fibers of the puncture resistant sheets of the second group ranges from 22.5 to 45 degrees out of alignment.

30. The garment of claim 29 further comprising a third group of puncture resistant sheets positioned adjacent to the second group of puncture resistant sheets, in which the third group has at least two successive overlying puncture resistant sheets, and in which the aramid warp fibers and aramid weft fibers for individual ones of the puncture resistant sheets of the third group are substantially in alignment to one another and are angularly displaced relative to the aramid warp fibers and aramid weft fibers of the puncture resistant sheets of the second group.

31. The garment of claim 30 in which the aramid warp fibers and aramid weft fibers of the overlying puncture resistant sheets of the third group are substantially in alignment with the aramid warp fibers and aramid weft fibers of the overlying puncture resistant sheets of the first group.

32. The garment of claim 30 in which the first group, second group and third group of the puncture resistant sheets have an equal number of successive overlying puncture resistant sheets.

33. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000, 000 to 90,000,000 filament crossovers per square inch; b) a break elongation of greater than 3.0 percent; and c) a tenacity of greater than 23.8 grams per denier;

a plurality of ballistic resistant sheets of woven lyotropic liquid crystal polymer fiber formed from poly (p-phenylene-2,6-benzobisoxazole), the ballistic resistant sheets have a warp of less than 60 lyotronic liquid crystal polymer fibers per inch and a weft of less than 60 lyotropic liquid crystal polymer fibers per inch; and a multipurpose stab and ballistic resistant pad which comprises the puncture resistant sheets and ballistic resistant sheets in which the pad meets a level of stab resistance under National Institute of Justice Standard 0115.00 for Spike Level 1 and a level of ballistic resistance under National Institute of Justice Standard 0101.04 for Threat Level IIA.

34. The garment of claim 33 in which the pad comprises no more than eight (8) puncture resistant sheets and no more than sixteen (16) ballistic resistant sheets.

35. The garment of claim 34 in which the pad has an areal density not greater than 0.56 lbs/ft$^2$.

36. The garment of claim 35 in which the combined areal density of the plurality of puncture resistant sheets is not greater than 0.21 lbs/ft$^2$ and the combined areal density of the plurality of ballistic resistant sheets is not greater than 0.36 lbs/ft$^2$.

37. The garment of claim 34 in which the pad has a thickness not greater than 0.15 inches.

38. The garment of claim 37 in which the combined thickness of the plurality of puncture resistant sheets is not greater than 0.05 inches and the combined thickness of the plurality of ballistic resistant sheets is not greater than 0.10 inches.

39. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000, 000 to 90,000,000 filament crossovers per square inch;

b) a break elongation of greater than 3.0 percent; and c) a tenacity of greater than 23.8 grams per denier;

a plurality of ballistic resistant sheets of formed from poly (p-phenylene-2,6-benzobisoxazle), the ballistic resistant sheets have a warp of less than 60 lyotropic liquid crystal polymer fibers per inch and a weft of less than 60 lyotropic liquid crystal polymer fibers per inch; and a multipurpose stab and ballistic resistant pad which comprises the puncture resistant sheets and ballistic resistant sheets in which the pad meets a level of stab resistance under National Institute of Justice Standard 0115.00 for Spike Level 2 and a level of ballistic resistance under National Institute of Justice Standard 0101.04 for Threat Level II.

40. The garment of claim 39 in which the pad comprises no more than twelve (12) puncture resistant sheets and no more than twenty-two (22) ballistic resistant sheets.

41. The garment of claim 40 in which the pad has an areal density not greater than 0.80 lbs/ft$^2$.

42. The garment of claim 41 in which the combined areal density of the plurality of puncture resistant sheets is not greater than 0.31 lbs/ft$^2$ and the combined areal density of the plurality of ballistic resistant sheets is not greater than 0.49 lbs/ft$^2$.

43. The garment of claim 40 in which the pad has a thickness not greater than 0.21 inches.

44. The garment of claim 43 in which the combined thickness of the plurality of puncture resistant sheets is not greater than 0.07 inches and the combined thickness of the plurality of ballistic resistant sheets is not greater than 0.14 inches.

45. A multipurpose stab and ballistic resistant garment comprising:

a plurality of puncture resistant sheets of woven aramid fibers in which the puncture resistant sheets are formed from a weave of at least 60 aramid warp fibers per inch and at least 60 aramid weft fibers per inch in which the aramid fibers of the puncture resistant sheets have at least one of: a) filaments which provide from 50,000,000 to 90,000,000 filament crossovers per square inch; b) a break elongation of greater than 3.0 percent; and c) a tenacity of greater than 23.8 grams per denier;

a plurality of ballistic resistant sheets of woven lyotropic liquid crystal polymer fiber formed from poly (p-phenylene-2,6-benzobisoxazole), the ballistic resistant sheets have a warp of less than 60 lyotropic liquid crystal polymer fibers per inch and a weft of less than 60 lyotropic liquid crystal polymer fibers per inch; and a multipurpose stab and ballistic resistant pad which comprises the puncture resistant sheets and ballistic resistant sheets in which the pad meets a level of stab resistance under National Institute of Justice Standard 0115.00 for Spike Level 3 and a level of ballistic resistance under National Institute of Justice Standard 0101.04 for Threat Level IIIA.

46. The garment of claim 45 in which the pad comprises no more than fourteen (14) puncture resistant sheets and no more than twenty-eight (28) ballistic resistant sheets.

47. The garment of claim 46 in which the pad has an areal density not greater than 0.98 lbs/ft$^2$.

48. The garment of claim 47 in which the combined areal density of the plurality of puncture resistant sheets is not greater than 0.36 lbs/ft$^2$ and the combined areal density of the plurality of ballistic resistant sheets is not greater than 0.62 lbs/ft$^2$.

49. The garment of claim 46 in which the pad has a thickness not greater than 0.26 inches.

50. The garment of claim 49 in which the combined thickness of the plurality of puncture resistant sheets is not greater than 0.08 inches and the combined thickness of the plurality of ballistic resistant sheets is not greater than 0.18 inches.

51. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch; placing a plurality of ballistic resistant sheets of woven lyotropic liquid crystal polymer fiber on at least one side of the plurality of puncture resistant sheets;

providing the ballistic resistant sheets with at least two successive overlying sheets;

angularly displacing a warp and a weft of one ballistic resistant sheet relative to a warp and a weft of a second ballistic resistant sheet overlying the one ballistic resistant sheet;

providing an annular displacement of the warp and weft of the one ballistic resistant sheet relative to the warp and the weft of the second ballistic resistant sheet to range from 22.5 degrees to 45 degrees out of alignment;

providing at least a third ballistic resistant sheet to overlie the second ballistic resistant sheet; and angularly displacing the warp and the weft of the third ballistic resistant sheet relative to the warp and weft of the second ballistic resistant sheet and substantially aligning the warp and the weft of the third ballistic resistant sheet with the warp and the weft of the first ballistic resistant sheet.

52. The method of claim 51 comprising the step of providing the warp of the ballistic resistant sheets to be than 60 lyotropic liquid crystal polymer fibers per inch and the weft to be less than 60 lyotropic liquid crystal polymer fibers per inch.

53. The method of claim 52 comprising the step of providing the lyotropic liquid crystal polymer fiber to have at least one of: a) a filament denier of 1.5 dpf; b) a density ranging from 1.54 to 1.56 g/cm$^3$; c) a tensile strength of 42 grams/denier; d) a tensile modulous ranging from 1300 to 2000 grams/denier; e) a decomposition temperature in air of 650 degrees centigrade; and f) a break elongation ranging from 2.5 percent to 3.5 percent.

54. The method of claim 52 in which the lyotropic liquid crystal polymer fiber is formed from poly (p-phenylene-2,6-benzobisoxazole).

55. The method of claim 54 comprising the step of providing the aramid fibers of the puncture resistant sheets have at least one of: a) filaments which provide from 50,000,000 to 90,000,000 filament crossovers per square inch; b) a break elongation of greater than 3.0 percent; and c) a tenacity of greater than 23.8 grams per denier.

56. The method of claim 55 comprising the step of positioning the puncture resistant sheets at a strike side of the garment relative to the ballistic resistant sheets.

57. The method of claim 51 comprising the step of positioning the first, second and third ballistic resistant sheets to be successively adjacent to one another such that the first ballistic resistant sheet is adjacent to the second ballistic resistant sheet and the second ballistic resistant sheet is adjacent to the third ballistic resistant sheet.

58. The method of claim 51 comprising the step of stitching the ballistic resistant sheets together with rows of stitches of aramid thread generally aligned in one direction and with rows of stitches of aramid thread generally aligned in another crossing direction to form a quilt stitch pattern.

59. The method of claim 51 comprising the step of securing the plurality of puncture resistant sheets together with a plurality of bar tac stitches positioned proximate a periphery of the puncture resistant sheets.

60. The method of claim 51 comprising the step of non-invasively holding the plurality of puncture resistant sheets and the plurality of ballistic resistant sheets to each other.

61. The method of claim 60 comprising the step of holding the puncture resistant sheets and ballistic resistant sheets to each other with tape.

62. The method of claim 60 comprising the step of covering the puncture resistant sheets and the ballistic resistant sheets with a pad cover constructed at least in part of waterproof and moisture vapor permeable material.

63. The method of claim 51 comprising the steps of providing the puncture resistant sheets with at least two successive overlying sheets, and angularly displacing the aramid warp fibers and the aramid weft fibers of one puncture resistant sheet relative to the aramid warp fibers and the aramid weft fibers of a second puncture resistant sheet overlying the one puncture resistant sheet.

64. The method of claim 63 comprising the step of providing an angular displacement of the aramid warp fibers and aramid weft fibers of the at least one puncture resistant sheet relative to the aramid warp fibers and aramid weft fibers of the second puncture resistant sheet to range from 22.5 to 45 degrees out of alignment.

65. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch;

providing the aramid fibers of the puncture resistant sheets to have at least one of: a) filaments which provide from 50,000,000 to 90,000,000 filament crossovers per square inch; b) a break elongation of greater than 3.0 percent; and c) a tenacity of greater than 23.8 grams per denier;

placing a plurality of ballistic resistant sheets of woven lyotropic liquid crystal polymer fiber formed from poly (p-phenylene-2,6-benzobisoxazole) on at least one side of the plurality of puncture resistant sheets;

providing the ballistic resistant sheets to have a warp of less than 60 lyotropic liquid crystal polymer fibers per inch and a weft of less than 60 lyotropic liquid crystal polymer fibers per inch;

providing the plurality of ballistic resistant sheets with a first group of at least two successive overlying woven ballistic resistant sheets, in which the warp and the weft for individual ones of the successive overlying woven ballistic resistant sheets of the first group are substantially in alignment to one another; and providing a second group of at least another two successive overlying woven ballistic resistant sheets, in which the warp and the weft for individual ones of the woven ballistic resistant sheets of the second group are substantially in alignment to one another and are angularly displaced from the warp and the weft of the woven ballistic resistant sheets of the first group.

66. The method of claim 65 comprising the step of providing the first group and the second group to have an equal number of successive overlying woven ballistic resistant sheets.

67. The method of claim 66 comprising the step of providing the first group and the second group to each have two successive overlying woven ballistic resistant sheets.

68. The method of claim 65 comprising the step of providing an angular displacement between the warp and the weft of the ballistic resistant sheets of the first group relative to the warp and the weft of the ballistic resistant sheets of the second group to range from 22.5 to 45 degrees out of alignment.

69. The method of claim 68 comprising the step of providing a third group of ballistic resistant sheets positioned adjacent to the second group, in which the third group has at least two successive overlying woven ballistic resistant sheets, and in which the warp and the weft for individual ones of the woven ballistic resistant sheets of the third group are substantially in alignment to one another and are angularly displaced relative to the warp and the weft of the woven ballistic resistant sheets of the second group.

70. The method of claim 69 comprising the step of providing the warp and the weft of the overlying woven ballistic resistant sheets of the third group to be substantially in alignment with the warp and the weft of the overlying woven ballistic resistant sheets of the first group.

71. The method of claim 69 comprising the step of providing the first group, second group and third group to have an equal number of successive overlying woven sheets.

72. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch;

providing the aramid fibers of the puncture resistant sheets to have at least one of: a) filaments which provide from 50,000,000 to 90,000,000 filament crossovers per square inch; b) a break elongation of greater than 3.0 percent; and c) a tenacity of greater than 23.8 grams per denier;

placing a plurality of ballistic resistant sheets of woven lyotropic liquid crystal polymer fiber formed from poly (p-phenylene-2,6-benzobisoxazole) on at least one side of the plurality of puncture resistant sheets;

providing the ballistic resistant sheets to have a warp of less than 60 lyotropic liquid crystal polymer fibers per inch and a weft of less than 60 lyotropic liquid crystal polymer fibers per inch;

providing the ballistic resistant sheets with at least two successive overlying sheets;

angularly displacing the warp and weft of one ballistic resistant sheet relative to the warp and the weft of a second ballistic resistant sheet overlying the one ballistic resistant sheet; and stitching the ballistic resistant sheets together with at least six vertical rows of lyotropic liquid crystal polymer fiber thread and with at least three horizontal rows of lyotropic liquid crystal polymer fiber thread such that the horizontal rows cross the pertical rows to form a box stitch pattern on at least a portion of the plurality of ballistic resistant sheets.

73. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch;

providing the aramid fibers of the puncture resistant sheets to have at least one of: a) filaments which provide from 50,000,000 to 90,000,000 filament cross-overs per square inch; b) a break elongation of greater than 3.0 percent; and c) a tenacity of greater than 23.8 grams per denier;

providing the puncture resistant sheets with at least two successive overlying sheets;

angularly displacing the aramid warp fibers and the aramid weft fibers of one puncture resistant sheet relative to the aramid warp fibers and the aramid weft fibers of a second puncture resistant sheet overlying the one puncture resistant sheet;

providing an angular displacement of the aramid warp fibers and aramid weft fibers of the one puncture resistant sheet relative to the aramid warp fibers and aramid weft fibers of the second puncture resistant sheet to range from 22.5 to 45 degrees out of alignment;

providing at least a third puncture resistant sheet to overly the second puncture resistant sheet;

angularly displacing the aramid warp fibers and aramid weft fibers of the third puncture resistant sheet relative to the aramid warp fibers and aramid weft fibers of the second puncture resistant sheet and substantially aligning the aramid warp fibers and aramid weft fibers of the third puncture resistant sheet with the aramid warp fibers and aramid weft fibers of the first puncture resistant sheet;

placing a plurality of ballistic resistant sheets of woven lyotropic liquid crystal polymer fiber formed from poly (p-phenylene-2,6-benzobisoxazole) on at least one side of the plurality of puncture resistant sheets; and providing the ballistic resistant sheets to have a warp of less than 60 lyotropic liquid crystal polymer fibers per inch and a weft of less than 60 lyotropic liquid crystal polymer fibers per inch.

74. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch;

providing the aramid fibers of the puncture resistant sheets to have at least one of: a) filaments which provide from 50,000,000 to 90,000,000 filament cross-overs per square inch; b) a break elongation of greater than 3.0 percent; and c) atenacity of greater than 23.8 grams per denier;

providing the plurality of puncture resistant sheets with a first group of at least two successive overlying puncture resistant sheets, in which the aramid warp fibers and the aramid weft fibers for individual ones of the successive overlying puncture resistant sheets of the first group are substantially in alignment to one another;

providing a second group of at least another two successive overlying puncture resistant sheets, in which the aramid warp fibers and the aramid weft fibers for individual ones of the puncture resistant sheets of the second group are substantially in alignment to one another and are angularly displaced from the aramid warp fibers and aramid weft fibers of the puncture resistant sheets of the first group;

placing a plurality of ballistic resistant sheets of woven lyotropic liquid crystal polymer fiber formed from poly (p-phenylene-2,6-benzobisoxazole) on at least one side of the plurality of puncture resistant sheets; and providing the ballistic resistant sheets to have a warp of less than 60 lyotropic liquid crystal polymer fibers per inch and a weft of less than 60 lyotropic liquid crystal polymer fibers per inch.

75. The method of claim 74 comprising the step of providing the first group and second group to have an equal number of successive overlying puncture resistant sheets.

76. The method of claim 75 comprising the step of providing the first group and the second group to each have two successive overlying puncture resistant sheets.

77. The method of claim 76 comprising the step of establishing the angular displacement between the aramid warp fibers and the aramid weft fibers of the puncture resistant sheets of the first group relative to the aramid warp fibers and aramid weft fibers of the puncture resistant sheets of the second group to range from 22.5 to 45 degrees out of alignment.

78. The method of claim 77 comprising the steps of positioning a third group of puncture resistant sheets to be adjacent to the second group of puncture resistant sheets, in which the third group has at least two successive overlying puncture resistant sheets, positioning the aramid warp fibers and aramid weft fibers for individual ones of the puncture resistant sheets of the third group to be substantially in alignment to one another; and angularly displacing the aramid warp fiber and aramid weft fibers of the puncture resistant sheets of the third group relative to the aramid warp fibers and aramid weft fibers of the puncture resistant sheets of the second group.

79. The method of claim 78 comprising the step of a substantially aligning the aramid warp fibers and aramid weft fibers of the overlying puncture resistant sheets of the third group with the aramid warp fibers and aramid weft fibers of the overlying puncture resistant sheets of the first group.

80. The method of claim 78 comprising the step of providing the first group, second group and third group of the puncture resistant sheets to have an equal number of successive overlying puncture resistant sheets.

81. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch;

providing the aramid fibers of the puncture resistant sheets to have at least one of: a) filaments which provide from 50,000,000 to 90,000,000 filament cross-overs per square inch; b) a break elongation of greater than 3.0 percent; and c) a tenacity of greater than 23.8 grams per denier;

placing a plurality of ballistic resistant sheets of woven lyotropic liquid crystal polymer from poly (p-phenylene-2,6-benzobisoxazole) on at least one side of the plurality of puncture resistant sheets;

providing the ballistic resistant sheets to have a warp of less than 60 lyotropic liquid crystal polymer fibers per inch and a weft of less than 60 lyotropic liquid crystal polymer fibers per inch; and forming a multipurpose stab and ballistic resistant pad which comprises the puncture resistant sheets and ballistic resistant sheets such that the pad meets a level of stab resistance under National Institute of Justice Standard 0115.00 for Spike Level 1 and a level of ballistic resistance under National Institute of Justice Standard 0101.04 for Threat Level IIA.

82. The method of claim 81 comprising the step of forming the pad with no more than eight (8) puncture resistant sheets and no more than sixteen (16) ballistic resistant sheets.

83. The method of claim 82 comprising the step of providing the pad with an areal density not greater than 0.56 lbs/ft$^2$.

84. The method of claim 83 comprising the step of providing the pad with a combined areal density for the plurality of puncture resistant sheets to be no greater than 0.21 lbs/ft$^2$ and a combined areal density for the plurality of ballistic resistant sheets to be no greater than 0.36 lbs/ft$^2$.

85. The method of claim 82 comprising the step of providing the pad with a thickness not greater than 0.15 inches.

86. The method of claim 85 comprising the step of providing the pad with a combined thickness for the plurality of puncture resistant sheets to be no greater than 0.05 inches and the combined thickness of the plurality of ballistic resistant sheets is not greater than 0.10 inches.

87. The method of claim 81 comprising the step of forming the pad with no more than twelve (12) puncture resistant sheets and no more than twenty-two (22) ballistic resistant sheets.

88. The method of claim 87 comprising the step of providing the pad has with an areal density not greater than 0.80 lbs/ft$^2$.

89. The method of claim 88 comprising the step of providing the pad with a combined areal density for the plurality of puncture resistant sheets to be no greater than 0.31 lbs/ft$^2$ and a combined areal density for the plurality of ballistic resistant sheets to be no greater than 0.49 lbs/ft$^2$.

90. The method of claim 87 comprising the step of providing the pad with a thickness not greater than 0.21 inches.

91. The method of claim 90 comprising the step of providing the pad with a combined thickness for the plurality of puncture resistant sheets to be no greater than 0.07 inches and a combined thickness for the plurality of ballistic resistant sheets to be no greater than 0.14 inches.

92. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch;

providing the aramid fibers of the puncture resistant sheets to have at least one of: a) filaments which provide from 50,000,000 to 90,000,000 filament cross-overs per square inch; b) a break elongation of greater than 3.0 percent; and c) a tenacity of greater than 23.8 grams per denier;

placing a plurality of ballistic resistant sheets of woven lyotropic liquid crystal polymer from poly (p-phenylene-2,6-benzobisoxazole) on at least one side of the plurality of puncture resistant sheets;

providing the ballistic resistant sheets to have a warp of less than 60 lyotropic liquid crystal polymer fibers per inch and a weft of less than 60 lyotropic liquid crystal polymer fibers per inch; and forming a multipurpose stab and ballistic resistant pad which comprises the puncture resistant sheets and ballistic resistant sheets such that the pad meets a level of stab resistance under National Institute of Justice Standard 0115.00 for Spike Level 2 and a level of ballistic resistance under National Institute of Justice Standard 0101.04 for Threat Level II.

93. A method of making a multipurpose stab and ballistic resistant garment comprising:

positioning a plurality of puncture resistant sheets of woven aramid fibers to overlie one another in which the puncture resistant sheets are formed from a weave of at least 60 aramid warp fibers per inch and at least 60 aramid weft fibers per inch;

providing the aramid fibers of the puncture resistant sheets to have at least one of: a) filaments which provide from 50,000,000 to 90,000,000 filament cross-overs per square inch; b) a break elongation of greater than 3.0 percent; and c) a tenacity of greater than 23.8 grams per denier;

placing a plurality of ballistic resistant sheets of woven lyotropic liquid crystal polymer from poly (p-phenylene-2,6-benzobisoxazole) on at least one side of the plurality of puncture resistant sheets;

providing the ballistic resistant sheets to have a warp of less than 60 lyotropic liquid crystal polymer fibers per inch and a weft of less than 60 lyotropic liquid crystal polymer fibers per inch; and forming a multipurpose stab and ballistic resistant pad which comprises the puncture resistant sheets and ballistic resistant sheets such that the pad meets a level of stab resistance under National Institute of Justice Standard 0115.00 for Spike Level 3 and a level of ballistic resistance under National Institute of Justice Standard 0101.04 for Threat Level IIIA.

94. The method of claim 72 comprising the step of forming the pad with no more than fourteen (14) puncture resistant sheets and no more than twenty-eight (28) ballistic resistant sheets.

95. The method of claim 94 comprising the step of providing pad with an areal density not greater than 0.98 lbs/ft$^2$.

96. The method of claim 95 comprising the step of providing the pad with a combined areal density for the plurality of puncture resistant sheets is to be no greater than 0.36 lbs/ft$^2$ and the combined areal density of the plurality of ballistic resistant sheets is not greater than 0.62 lbs/ft$^2$.

97. The method of claim 94 comprising the step of providing the pad with a thickness not greater than 0.26 inches.

98. The method of claim 97 comprising the step of providing the pad with a combined thickness for the plurality of puncture resistant sheets to be no greater than 0.08 inches and a combined thickness for the plurality of ballistic resistant sheets to be no greater than 0.18 inches.

* * * * *

UNITED STATES PATENT AND TRADEMARK OFFICE

CERTIFICATE OF CORRECTION

PATENT NO. : 6,922,847 B2
DATED : August 2, 2005
INVENTOR(S) : Thomas E. Bachner, Jr.

It is certified that error appears in the above-identified patent and that said Letters Patent is hereby corrected as shown below:

Column 14,
Line 4, after "is" delete "of".

Column 20,
Line 22, change "annular" to -- angular --.

Column 22,
Line 62, change "pertical" to -- vertical --.

Column 23,
Line 55, change "atenacity" to -- tenacity --.

Column 24,
Line 36, change "fiber" to -- fibers --.

Column 26,
Line 42, change "72" to -- 93 --.

Signed and Sealed this

Thirtieth Day of May, 2006

JON W. DUDAS
*Director of the United States Patent and Trademark Office*